US009977355B2

(12) United States Patent
Takemori

(10) Patent No.: US 9,977,355 B2
(45) Date of Patent: May 22, 2018

(54) TONER, ONE-COMPONENT DEVELOPER, AND TWO-COMPONENT DEVELOPER

(71) Applicant: KYOCERA Document Solutions Inc., Osaka (JP)

(72) Inventor: Toshiki Takemori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/648,522

(22) Filed: Jul. 13, 2017

(65) Prior Publication Data

US 2018/0024451 A1 Jan. 25, 2018

(30) Foreign Application Priority Data

Jul. 21, 2016 (JP) ..... 2016-143446

(51) Int. Cl.

| | |
|---|---|
| ***G03G 9/08*** | (2006.01) |
| ***G03G 9/083*** | (2006.01) |
| ***G03G 9/093*** | (2006.01) |

(52) U.S. Cl.

CPC ..... *G03G 9/0838* (2013.01); *G03G 9/0833* (2013.01); *G03G 9/0836* (2013.01); *G03G 9/0837* (2013.01); *G03G 9/093* (2013.01); *G03G 9/09328* (2013.01); *G03G 9/09342* (2013.01)

(58) Field of Classification Search

CPC .. G03G 9/09342; G03G 9/093; G03G 9/0836; G03G 9/0837; G03G 9/0838

USPC ..... 430/110.2, 106.2

See application file for complete search history.

(56) References Cited

U.S. PATENT DOCUMENTS

2005/0271964 A1 12/2005 Etou et al.

FOREIGN PATENT DOCUMENTS

JP 2004294468 A 10/2004

*Primary Examiner* — Mark A Chapman

(74) *Attorney, Agent, or Firm* — Studebaker & Brackett PC

(57) ABSTRACT

A plurality of toner particles each include a toner core, a shell layer covering a surface of the toner core, and a plurality of magnetic particles penetrating the shell layer. Each of the magnetic particles has an embedded portion and a protrusion portion. The embedded portions are embedded in the surface of the toner core. The protrusion portions are located further outward than the embedded portions in a radial direction of the toner particle and protrude outward from a surface of the shell layer in the radial direction of the toner particle. An average Heywood diameter X of the magnetic particles, a shell layer thickness Y, and an average value Z of protrusion heights of the respective magnetic particles satisfy relation (1) and relation (2) shown below.

$$0<Z\leq(X/2) \quad (1)$$

$$10\ \text{nm}\leq Y\leq 50\ \text{nm} \quad (2)$$

7 Claims, 2 Drawing Sheets

TONER, ONE-COMPONENT DEVELOPER, AND TWO-COMPONENT DEVELOPER

INCORPORATION BY REFERENCE

The present application claims priority under 35 U.S.C. § 119 to Japanese Patent Application No. 2016-143446, filed on Jul. 21, 2016. The contents of this application are incorporated herein by reference in their entirety.

BACKGROUND

The present disclosure relates to toners, one-component developers, and two-component developers.

Some image forming apparatuses form an image on a recording medium (for example, printing paper) by transferring a toner (unfixed toner) to the recording medium and fixing the unfixed toner to the recording medium through application of heat and pressure thereto using, for example, a fixing roller. In order to form an image of high quality with less energy for toner fixing, it is desired to improve fixability of the toner to the recording medium. For example, a known toner includes toner cores whose surfaces are each covered with a urea resin film. The urea resin film is formed by performing resinification of a concentrated urea resin precursor on the surfaces of the toner cores without causing melting of the toner cores.

SUMMARY

A toner according to an aspect of the present disclosure includes a plurality of the toner particles. Each of the toner particles includes a toner core, a shell layer covering a surface of the toner core, and a plurality of magnetic particles penetrating the shell layer. Each of the magnetic particles has an embedded portion and a protrusion portion. The embedded portions are embedded in the surface of the toner core. The protrusion portions are located further outward than the embedded portions in a radial direction of the toner particle and protrude outward from a surface of the shell layer in the radial direction of the toner particle. An average Heywood diameter X of the magnetic particles, a thickness Y of the shell layer, and an average value Z satisfy relation (1) and relation (2) shown below.

$$0<Z\leq(X/2) \quad (1)$$

$$10\text{ nm}\leq Y\leq 50\text{ nm} \quad (2)$$

The average value Z in relation (1) is an average value of lengths of the protrusion portions in the radial direction of the toner particle.

A one-component developer according to another aspect of the present disclosure includes the above-described toner.

A two-component developer according to another aspect of the present disclosure includes the above-described toner and a carrier that positively charges the toner through friction.

DETAILED DESCRIPTION

Figure 1:
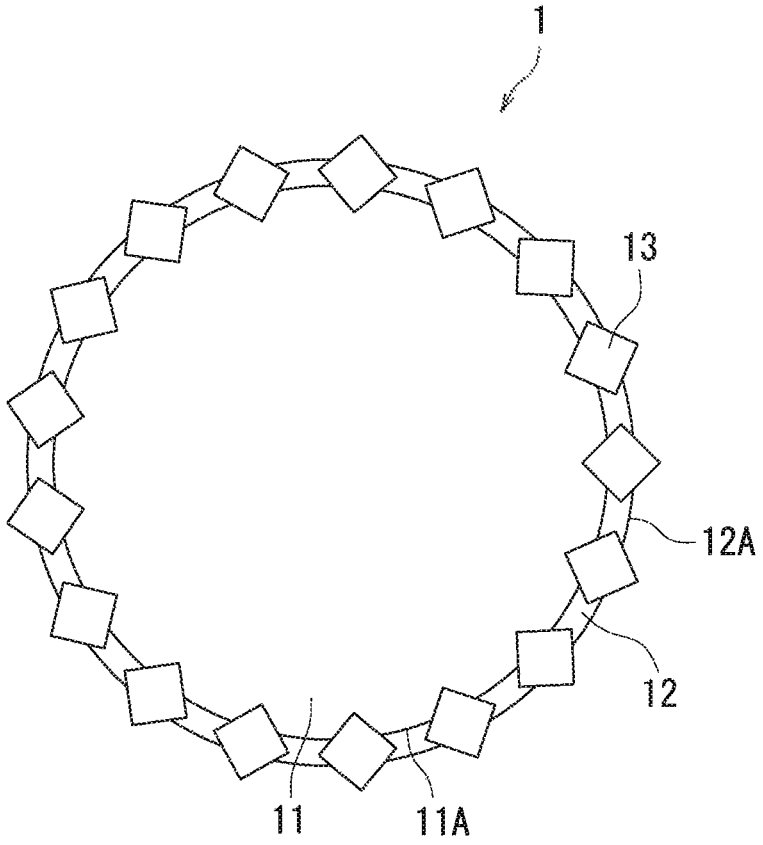
FIG. 1 is a cross-sectional view illustrating a toner particle included in a toner according to the present disclosure.

The following describes an embodiment of the present disclosure (herein referred to as "the present embodiment"). However, the present disclosure is not limited to the embodiment.

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

An average value used herein refers to a number average value unless otherwise stated. Evaluation values (for example, values indicating shape and physical properties) for a powder (specific examples include toner, toner cores, toner particles, and toner mother particles described later) are each a number average of values. A number average value is obtained by adding up values measured with respect to an appropriate number of measurement targets and dividing the sum by the number. The particle diameter of a powder is the diameter of a representative circle of a primary particle measured using an electron microscope, unless otherwise stated. The diameter of a representative circle is the diameter of a circle having the same area as a projection of the particle. The volume median diameter $D_{50}$ is a volume-based median diameter measured by a Coulter Counter method.

[Composition of Toner]

A toner according to the present embodiment includes a plurality of toner particles. Such a toner may be an electrostatic latent image developing toner that can be suitably used for development of an electrostatic latent image and can for example be used in image formation in an electrophotographic apparatus. The following describes an example of image forming methods that are performed by electrophotographic apparatuses.

First, a charger and a light exposure device of an electrophotographic apparatus forms an electrostatic latent image on a photosensitive member based on image data. Next, the electrostatic latent image that is formed is developed using a developer that contains a toner.

In the developing step, a development sleeve of a development roller disposed in the vicinity of the photosensitive member attracts the toner by magnetic force of a magnet roll in the development roller. Thus, the toner is carried on a surface of the development roller. The development sleeve then rotates thereby to supply the toner thereon to the photosensitive member. As a result, the toner adheres to the electrostatic latent image formed on the photosensitive member, forming a toner image on the photosensitive member.

Subsequently, in a transfer step, the toner image on the photosensitive member is transferred onto an intermediate transfer member, and then further transferred onto a recording medium. Next, a fixing device fixes the toner to the recording medium by applying heat and pressure to the toner. As a result, an image is formed on the recording medium. A full-color image can for example be formed by superimposing toner images of four different colors: black, yellow, magenta, and cyan. The toner image transfer process may be a direct transfer process that involves direct transfer of a toner image on the photosensitive member to the recording medium without the use of the intermediate transfer member. The toner fixing process is not limited to a nip fixing in which fixing is performed through a nip between a heating roller and a pressure roller, and may be a belt fixing process in which fixing is performed using a belt.

The toner particles included in the toner according to the present embodiment each include a toner core, a shell layer covering a surface of the toner core, and a plurality of magnetic particles penetrating the shell layer. Each of the magnetic particles has an embedded portion and a protrusion portion. The embedded portions are embedded in the surface of the toner core. The protrusion portions are located further outward than the embedded portions in a radial direction of the toner particle and protrude outward from a surface of the shell layer in the radial direction of the toner particle. An average Heywood diameter X of the magnetic particles, a shell layer thickness Y, and an average value Z satisfy relation (1) and relation (2) shown below.

$$0<Z\leq(X/2) \quad (1)$$

$$10\text{ nm}\leq Y\leq 50\text{ nm} \quad (2)$$

The average value Z in relation (1) is an average value of lengths of protrusion portions in the radial direction of the toner particle.

The "average Heywood diameter X of the magnetic particles" refers to an average value of diameters of circles having the same surface areas as projections of the magnetic particles. The average Heywood diameter of the magnetic particles is for example measured by a method described below. An appropriate number of magnetic particles are observed at a magnification of ×50,000 using a scanning electron microscope (SEM, for example, "JSM-880", product of JEOL Ltd.) and an image analyzer to measure Heywood diameters thereof. A sum of the measured Heywood diameters is divided by the number of the observed magnetic particles. Through the above, the average Heywood diameter (number average Heywood diameter) of the magnetic particles is determined.

The average Heywood diameter X of the magnetic particles can for example be adjusted by appropriately changing growth conditions of metal particles in formation of magnetic cores that are included in the magnetic particles. Examples of growth conditions of metal particles include a heating temperature of an aqueous metal solution, a rate of bubbling of air through the aqueous metal solution, and a period of time of bubbling of air through the aqueous metal solution.

The "shell layer thickness Y" means a dimension of the shell layer in the radial direction of the toner particle and is measured in accordance with a method described below. First, a transmission electron microscope (TEM) image of cross-sections of toner particles is captured. Next, the TEM image of the cross-sections of the toner particles is analyzed using image analysis software (for example, "WinROOF", product of Mitani Corporation). More specifically, on the cross-section of one of the toner particles, two straight lines are drawn to intersect at right angles at substantially the center of the cross-section. On the two respective straight lines, lengths (four lengths) that are each from an interface between the toner core and the shell layer (equivalent to the surface of the toner core) to the surface of the shell layer are measured. An average value of the thus measured four lengths is taken to be the thickness of the shell layer of the toner particle. Such shell layer thickness measurement is performed for a plurality of toner particles to obtain an average value of shell layer thicknesses for the toner particles (measurement targets). The average value of the shell layer thicknesses obtained as described above is taken to be the "shell layer thickness Y".

In a situation in which a boundary between a toner core and a shell layer is unclear in the TEM image of the cross-section of a toner particle, the TEM image of the cross-section of the toner particle is preferably analyzed using an electron energy loss spectrometer (EELS) (for example, "GIF TRIDIEM (registered Japanese trademark)", product of Gatan, Inc.) and image analysis software (for example, "WinROOF", product of Mitani Corporation). The use of an electron energy loss spectrometer and image analysis software makes the boundary between the toner core and the shell layer clear in the TEM image of the cross-section of the toner particle, enabling determination of the shell layer thickness Y.

The "average value Z of lengths of protrusion portions of the respective magnetic particles in the radial direction of the toner particle (also referred to below as an average value Z of magnetic particle protrusion heights)" is measured in accordance with a method described below. First, a TEM image of cross-sections of toner particles is captured. Next, the TEM image of the cross-sections of the toner particles is analyzed using image analysis software (for example, "WinROOF", product of Mitani Corporation). More specifically, a line length measurement function as a manual measurement function of a measurement tool is selected in the image analysis software. With the line length measurement function as the manual measurement function selected, several magnetic particles that are each partially embedded in the surface of the toner core are randomly selected in the TEM image of the cross-sections of the toner particles. The protrusion heights of the respective magnetic particles selected are measured, and a number average value thereof is calculated. The number average value of the protrusion heights of the magnetic particles obtained as described above is taken to be the "average value Z of magnetic particle protrusion heights".

Figure 2:
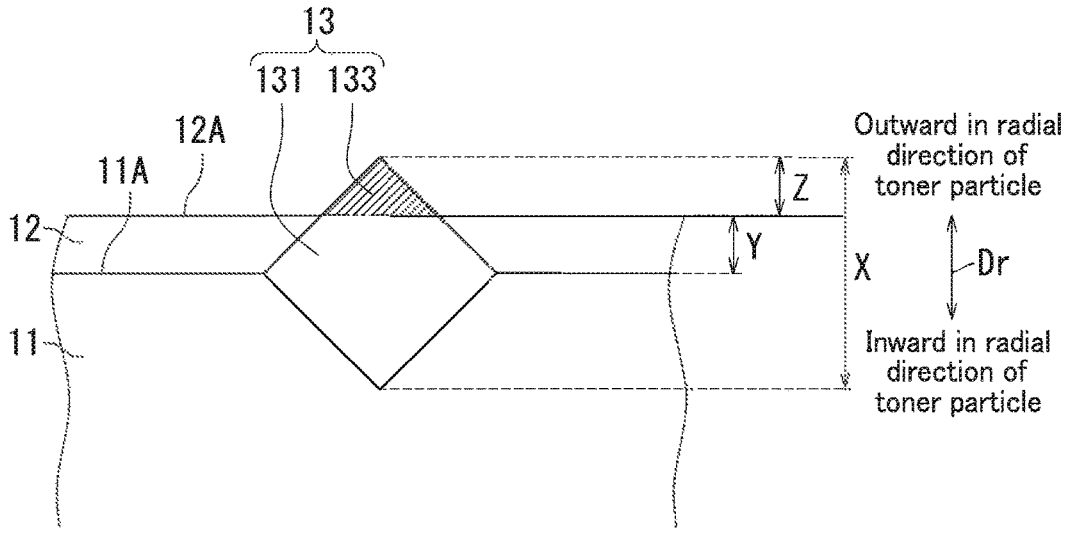
FIG. 2 is a schematic diagram for illustrating an average Heywood diameter X of the magnetic particles, a shell layer thickness Y, and an average value Z.

The following describes an example of the toner particles according to the present embodiment with reference to FIGS. 1 and 2. FIG. 1 is a cross-sectional view illustrating a toner particle 1 included in the toner according to the present embodiment. FIG. 2 is a schematic diagram for illustrating the average Heywood diameter X of the magnetic particles, the shell layer thickness Y, and the average value Z of magnetic particle protrusion heights.

Although a surface 11A of the toner core 11 and a surface 12A of a shell layer 12 are depicted using straight lines in FIG. 2, the surface of the toner core and the surface of the shell layer in an actual toner particle have spherical shapes (circular cross-sections). A direction Dr shown in FIG. 2 refers to the radial direction of the toner particle 1.

The toner illustrated in FIG. 1 includes a plurality of the toner particles 1. The toner particle 1 has the toner core 11, the shell layer 12 covering the surface 11A of the toner core 11, and a plurality of magnetic particles 13 penetrating the shell layer 12. An end section of each of the magnetic particles 13 that is located on one end of the magnetic particle 13 in the radial direction of the toner particle 1 (more specifically, an inner portion of each of the magnetic particles 13 in the radial direction of the toner core 1) is embedded in the surface 11A of the toner core 11. Another end section of each of the magnetic particles 13 that is located on the other end of the magnetic particle 13 in the radial direction of the toner particle 1 (more specifically, an outer portion of each of the magnetic particles 13 in the radial direction of the toner core 1) protrudes outward from the surface 12A of the shell layer 12 in the radial direction of the toner particle 1. In other words, each of the magnetic particles 13 has an embedded portion 131 and a protrusion portion 133. The embedded portions 131 are embedded in the surface 11A of the toner core 11. The protrusion portions 133 are located further outward than the embedded portions 131 in the radial direction of the toner particle 1 and protrude outward from the surface 12A of the shell layer 12 in the radial direction of the toner particle 1. Each of the protrusion portions 133 is equivalent to a shaded portion in FIG. 2. The average Heywood diameter X of the magnetic particles, the shell layer thickness Y, and the average value Z of magnetic particle protrusion heights for example satisfy relation (1) and relation (2) shown below. The average value Z of magnetic particle protrusion heights is an average value of lengths of the protrusion portions 133 in the radial direction of the toner particle 1.

$$0<Z\leq(X/2) \quad (1)$$

$$10\text{ nm}\leq Y\leq 50\text{ nm} \quad (2)$$

The toner according to the present embodiment has excellent low-temperature fixability. The use of a developer containing the toner according to the present embodiment in image formation allows prevention of fogging. The use of a developer containing the toner according to the present embodiment also allows maintenance of high developing properties even if image formation is performed in a low-humidity environment. Furthermore, the use of a developer containing the toner according to the present embodiment allows formation of an image of high quality. The following further describes the toner according to the present embodiment with reference to FIG. 1.

The toner particle 1 according to the present embodiment has the shell layer 12 covering the surface 11A of the toner core 11. The shell layer thickness Y satisfies 10 nm≤Y≤50 nm. As a result of the shell layer thickness Y being at least 10 nm, a resin component contained in the toner core 11 is prevented from melting during toner fixing. Examples of resin components that can be contained in the toner core 11 include a binder resin and a wax. As a result of the shell layer thickness Y being no greater than 50 nm, a resin component contained in the shell layer 12 melts during toner fixing, ensuring toner fixability. For the reasons given above, the toner having a shell layer thickness Y of at least 10 nm and no greater than 50 nm has improved low-temperature fixability.

Furthermore, the magnetic particles 13 in the toner according to the present embodiment penetrate the shell layer 12. A portion of each of the magnetic particle 13 that is located within the shell layer 12 can therefore be a starting point of rupture of the shell layer 12 upon application of heat and pressure to the toner during toner fixing.

Also for the reason given above, the toner therefore has improved low-temperature fixability.

Furthermore, in the toner according to the present embodiment, the magnetic particles 13 have the embedded portions 131, preventing the magnetic particles 13 from being detached from the surface 11A of the toner core 11. Besides, the toner according to the present embodiment satisfies Z≤(X/2). The magnetic particles 13 can therefore be prevented from being detached from the surface 12A of the shell layer 12. For the reasons given above, image formation can be performed with the toner particles 1 each containing the magnetic particles 13. Thus, the toner particles 1 are susceptible to magnetic confinement by a magnetic roller, preventing scattering of insufficiently charged toner (for example, non-charged toner). As a result, occurrence of fogging can be prevented.

The use of the toner according to the present embodiment allows image formation to be performed with the toner particles 1 each containing the magnetic particles 13. The toner according to the present embodiment satisfies 0<Z. During image formation, therefore, the magnetic particles 13 (more specifically, the protrusion portions 133 of the magnetic particles 13) readily come in contact with the surface of the photosensitive member, restricting contact between the shell layer 12 and the surface of the photosensitive member to a small area. Thus, a resin component contained in the toner particles 1 can be prevented from adhering to the surface of the photosensitive member. Besides, even if the resin component contained in the toner particles 1 adheres to the surface of the photosensitive member, the resin component adhering to the surface of the photosensitive member will be scraped off by the magnetic particles 13 (more specifically, the protrusion portions 133 of the magnetic particles 13) that have come in contact with the surface of the photosensitive member. Thus, contamination of the surface of the photosensitive member with the resin component (resin component contained in the toner particles 1) can be prevented more reliably. As a result, occurrence of fogging can be prevented.

Since the toner according to the present embodiment satisfies 0<Z, electrical charge resulting from overcharging of the toner can readily escape through the magnetic particles 13. Thus, excessive charging of the toner can be prevented even if image formation is performed in an environment in which excessive charging is likely. As a result, the toner has improved charge stability, and thus developing properties thereof can be kept high. Examples of environments in which excessive charging is likely include a low-humidity environment. That is, the toner according to the present embodiment can maintain its high developing properties even if image formation is performed in a low-humidity environment. In other words, the toner according to the present embodiment can for example form an image with a high image density even if image formation is performed in a low-humidity environment. Excessive charging as used herein refers to a phenomenon of a toner excessively charged to positive polarity. The toner having excellent charge stability refers to a toner having a sharp charge distribution, being capable of maintaining charge thereof at a desired amount when image formation with the use of the toner is started, and being capable of maintaining charge thereof at a desired amount when image formation with the use of the toner is successively performed.

Since the toner according to the present embodiment satisfies Z≤(X/2), projections and recesses in the surfaces of the toner particles 1 can be restricted to small sizes. Thus, fluidity of the toner particles 1 can be kept high. As a result, aggregation of the toner particles 1 can be prevented, allowing formation of an image of high quality.

The toner particles 1 may each include magnetic particles that are not embedded in the surface of the toner core thereof or may include magnetic particles that are entirely located within the shell layer thereof. The toner may further include toner particles each including a toner core having a surface in which portions of the respective magnetic particles are embedded and including no shell layer.

Preferably, the magnetic particles have an average Heywood diameter X of at least 100 nm and no greater than 300 nm. As a result of the magnetic particles having an average Heywood diameter X of at least a 100 nm, the magnetic particles 13 can have and maintain higher dispersibility. Thus, the magnetic particles 13 readily adhere to the surface 11A of the toner core 11 in a uniform manner in the production of the toner particle 1. As a result, the toner tends to have a sharp charge distribution, and excessive charging is prevented more effectively. As a result of the magnetic particles 13 readily adhering to the surface 11A of the toner core 11 in a uniform manner, the portion of each of the magnetic particles 13 that is located within the shell layer 12 readily becomes a starting point of rupture of the shell layer 12 during toner fixing. Thus, the toner has further improved low-temperature fixability.

As a result of the magnetic particles having an average Heywood diameter X of no greater than 300 nm, the magnetic particles 13 can be more effectively prevented from being detached from the surface 11A of the toner core 11. Thus, scattering of insufficiently charged toner (for example, non-charged toner) during image formation can be prevented more effectively. Accordingly, occurrence of fogging can be prevented more effectively.

As a result of the magnetic particles having an average Heywood diameter X of no greater than 300 nm, sharp particle size distribution of the magnetic particles 13 can be maintained. The magnetic particles 13 therefore readily adhere to the surface 11A of the toner core 11 in a uniform manner. Thus, the same effect as the effect obtained as a result of the magnetic particles having an average Heywood diameter X of at least 100 nm can be obtained. That is, the toner has further improved low-temperature fixability.

Besides, as a result of the magnetic particles having an average Heywood diameter X of no greater than 300 nm, provision of a sufficient amount of magnetic particles 13 at the surface 11A of the toner core 11 is ensured. The portion of each of the magnetic particles 13 that is located within the shell layer 12 can function as a starting point of rupture of the shell layer 12 during toner fixing. Accordingly, the shell layer 12 is readily ruptured during toner fixing. Also for the reason given above, the toner has further improved low-temperature fixability.

Preferably, the magnetic particles 13 each have a polyhedral shape. The magnetic particles 13 having a polyhedral shape have vertices and edges. The magnetic particles 13 come in contact with the surface of the photosensitive member at the vertices and edges thereof during image formation. A resin component adhering to the surface of the photosensitive member is scraped off more easily when the magnetic particles 13 are in contact with the surface of the photosensitive member at the vertices and edges thereof than when the magnetic particles 13 are in contact with the surface of the photosensitive member at faces thereof. Occurrence of fogging can be therefore prevented more effectively in such a configuration than in a configuration in which the magnetic particles do not have vertices or edges, that is, when the magnetic particles have for example a spherical shape.

The magnetic particles 13 penetrate the shell layer 12. The vertices and edges of the magnetic particles 13 function as starting points of rupture of the shell layer 12 better than the faces of the magnetic particles 13 during toner fixing. As described above, the shell layer 12 is readily ruptured during toner fixing in a configuration in which the magnetic particles 13 have a polyhedral shape. As a result, the toner has further improved low-temperature fixability.

Besides, electric charge is readily released from the vertices and edges of the magnetic particles 13. The toner particles 1 containing the magnetic particles 13 having a polyhedral shape can therefore prevent an excessive increase in charge compared to the toner particles containing magnetic particles having a spherical shape.

The polyhedral shape is for example an octahedral shape or a hexahedral shape. Specific examples of the octahedral shape include an octahedral shape with eight triangular faces. Specific examples of the hexahedral shape include an hexahedral shape with six rectangular faces. The vertices and edges of the polyhedron may be sharp. The shape of the magnetic particles can for example be confirmed by observing the magnetic particles at a magnification of ×50,000 using a scanning electron microscope (SEM, "JSM-880", product of JEOL Ltd.).

Preferably, the magnetic particles 13 are contained in an amount of at least 0.5 parts by mass and no greater than 3.0 parts by mass relative to 100.0 parts by mass of the toner cores 11. The portion of each of the magnetic particles 13 that is located within the shell layer 12 can function as a starting point of rupture of the shell layer 12 during toner fixing. As a result of the magnetic particles 13 being contained in an amount of at least 0.5 parts by mass relative to 100.0 parts by mass of the toner cores 11, the shell layers 12 are readily ruptured during toner fixing. Thus, the toner has further improved low-temperature fixability.

The magnetic particles 13 tend not to melt during toner fixing. As a result of the magnetic particles 13 being contained in an amount of no greater than 3.0 parts by mass relative to 100.0 parts by mass of the toner cores 11, the component that tends not to melt during toner fixing can be restricted to a small amount. Also for the reason given above, the toner has further improved low-temperature fixability.

As a result of the magnetic particles 13 being contained in an amount of at least 0.5 parts by mass relative to 100.0 parts by mass of the toner cores 11, occurrence of excessive charging can be prevented even in the case of continuous printing. Thus, the image density of an image that is formed can be kept high. As a result of the magnetic particles 13 being contained in an amount of no greater than 3.0 parts by mass relative to 100.0 parts by mass of the toner cores 11, charge of the toner can be maintained even in the case of continuous printing.

Besides, as a result of the magnetic particles 13 being contained in an amount of at least 0.5 parts by mass relative to 100.0 parts by mass of the toner cores 11, the inner electrical resistance of the shell layers 12 is easily adjusted to a desired level. Thus, the toner has sharper charge distribution.

Preferably, the toner cores 11 do not contain magnetic particles as an internal additive. Even if the toner cores 11 do not contain magnetic particles as an internal additive, it is possible to obtain the effects of improving low-temperature fixability, preventing occurrence of fogging, and improving developing properties in image formation in a low-humidity environment. Through the above, the toner according to the present embodiment has been described with reference to FIGS. 1 and 2. The following further describes the composition of the toner in detail.

<Magnetic Particles>

Examples of metals that can be contained in the magnetic particles include ferromagnetic metals, alloys of ferromagnetic metals, metals obtained by doping iron oxide with cobalt or nickel, alloys that are free from the ferromagnetic metal elements and can become ferromagnetic through heat treatment, and chromium dioxide. Examples of ferromagnetic metals include iron, cobalt, and nickel. Iron may be used in the form of iron oxide (for example, triiron tetraoxide or ferrite). Specifically, triiron tetraoxide is magnetite.

Any one of the metals listed above may be used independently, or any two or more of the metals listed above may be used in combination for the magnetic particles. The magnetic particles preferably contain magnetite in terms of easily adjusting charge of the toner particles.

The surfaces of the magnetic particles are preferably treated with a surface treatment agent. For example, the magnetic particles are preferably coated with a surface treatment agent. As a result of the surfaces of the magnetic particles being treated with a surface treatment agent, it is thought that cationization and elution of some of the metal contained in the magnetic particles in an aqueous medium can be restricted in shell layer formation. This facilitates attachment of a material of the shell layers to the surfaces of the toner cores with portions of the respective magnetic particles embedded therein and in-situ polymerization of the material of the shell layers in the magnetic particles.

The magnetic particles whose surfaces are treated with a surface treatment agent each have a magnetic core and a coat layer. The coat layer is provided so as to cover the magnetic core. The magnetic core contains a metal contained in the magnetic particles. The coat layer contains the surface treatment agent or a hydrolysate of the surface treatment agent.

It is only necessary that at least part of the surface of the magnetic core is provided with the coat layer. In order to restrict cationization and elution of some of the metal contained in the magnetic particles in an aqueous medium in shell layer formation, it is preferable that the surface of the magnetic core is substantially entirely provided with the coat layer. A portion of the surface treatment agent contained in the coat layer may be chemically bound to a chemical group of the magnetic core (for example, a hydroxyl group) or to free water contained in the magnetic core.

Examples of surface treatment agents that can be contained in the coat layer include a silicon compound or a phosphate compound. One surface treatment agent may be used independently, or two or more surface treatment agents may be used in combination.

Examples of silicon compounds that can be used include alkyl trialkoxysilanes, dialkyldialkoxysilanes, trialkylalkoxysilanes, aryltrialkoxysilanes, and silicic acid compounds.

Examples of alkyl trialkoxysilanes that can be used include n-octyltriethoxysilane, methyltrimethoxysilane, methyltriethoxysilane, n-propyltrimethoxysilane, n-propyltriethoxysilane, hexyltrimethoxysilane, hexyltriethoxysilane, and decyltrimethoxysilane.

Examples of dialkyldialkoxysilanes that can be used include dimethyldimethoxysilane, dimethyldiethoxysilane, diethyldimethoxysilane, and diethyldiethoxysilane.

Examples of trialkylalkoxysilanes that can be used include trimethylmethoxysilane, trimethylethoxysilane, triethylmethoxysilane, and triethylethoxysilane.

Examples of aryltrialkoxysilanes that can be used include phenyltrimethoxysilane and phenyltriethoxysilane.

Examples of silicic acid compounds that can be used include alkyl silicates. Specific examples thereof include methyl silicate and ethyl silicate. In a configuration in which an alkyl silicate is used as the surface treatment agent, silica may be generated through hydrolysis of the alkyl silicate on the surfaces of the magnetic particles. Accordingly, the coat layer of each of the magnetic particle may contain silica, which is a hydrolysate of the surface treatment agent. The alkyl silicate is for example hydrolyzed through heating.

Preferably, an alkyl trialkoxysilane or an alkyl silicate is used as the surface treatment agent. The coat layers of the magnetic particles containing an alkyl trialkoxysilane as the surface treatment agent contain the alkyl trialkoxysilane. The coat layers of the magnetic particles containing an alkyl silicate as the surface treatment agent contain silica, which is a hydrolysate of the alkyl silicate. The use of an alkyl trialkoxysilane or an alkyl silicate as the surface treatment agent facilitates adjustment of triboelectric charge of the toner cores with portions of the respective magnetic particles embedded in the surfaces thereof to a desired level.

More preferably, n-octyltriethoxysilane is used as the surface treatment agent. The coat layers of the magnetic particles containing n-octyltriethoxysilane as the surface treatment agent contain n-octyltriethoxysilane. The use of n-octyltriethoxysilane as the surface treatment agent facilitates improvement in image density of an image that is formed even in the case of continuous image formation.

Preferably, the surface treatment agent is contained in an amount of at least 0.01 parts by mass and no greater than 2.00 parts by mass relative to 100.00 parts by mass of the magnetic cores. As a result of the surface treatment agent being contained in an amount within the above-specified range, it is thought that a powder composed of the magnetic particles (referred to below as a magnetic powder) can be negatively chargeable while being kept magnetic.

<Toner Cores>

The toner cores for example contain at least one of a binder resin, a colorant, and a releasing agent. However, non-essential components (for example, the binder resin, the colorant, or the releasing agent) may be omitted in accordance with intended use of the toner.

(Binder Resin)

No particular limitations are placed on the binder resin so long as the binder resin can be used for preparation of a toner. The binder resin is preferably a thermoplastic resin in order to improve fixability of the toner. Examples of preferable thermoplastic resins include styrene-based resins, acrylic acid-based resins, styrene-acrylic acid-based resins, polyethylene resins, polypropylene resins, vinyl chloride resins, polyester resins, polyamide resins, urethane resins, polyvinyl alcohol resins, vinyl ether resins, N-vinyl compound resins, and styrene-butadiene resins.

In a configuration in which a thermoplastic resin is used for the binder resin, one thermoplastic resin may be used independently, or two or more thermoplastic resins may be used in combination. A cross-linking agent or a thermosetting resin may be added to the thermoplastic resin. By partially introducing a cross-linking structure into the binder resin, preservability, shape retention, and durability of the toner are easily improved while also ensuring fixability of the toner.

The use of a higher functional thermoplastic resin as the binder resin facilitates formation of the shell layers on the surfaces of the toner cores with portions of the respective magnetic particles embedded therein. Preferably, the toner cores contain a polyester resin as the binder resin in order to improve colorant dispersibility in the binder resin and low-temperature fixability of the toner.

The polyester resin can for example be obtained through polycondensation or condensation copolymerization of an alcohol and a carboxylic acid. Examples of preferable alcohols that can be used in preparation of the polyester resin include diols, bisphenols, and tri- or higher-hydric alcohols.

Examples of diols that can be used include ethylene glycol, diethylene glycol, triethylene glycol, 1,2-propanediol, 1,3-propanediol, 1,4-butanediol, neopentyl glycol, 2-butene-1,4-diol, 1,5-pentanediol, 1,6-hexanediol, 1,4-cyclohexanedimethanol, dipropylene glycol, polyethylene glycol, polypropylene glycol, and polytetramethylene glycol.

Examples of bisphenols that can be used include bisphenol A, hydrogenated bisphenol A, bisphenol A ethylene oxide adduct, and bisphenol A propylene oxide adduct.

Examples of tri- or higher-hydric alcohols that can be used include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of carboxylic acids that can be used in synthesis of the polyester resin include di-, tri-, and higher-basic carboxylic acids.

Examples of di-basic carboxylic acids that can be used include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acid, and alkenyl succinic acid. Examples of alkyl succinic acids include n-butylsuccinic acid, isobutylsuccinic acid, n-octylsuccinic acid, n-dodecylsuccinic acid, and isododecylsuccinic acid. Examples of alkenyl succinic acids include n-butenylsuccinic acid, isobutenylsuccinic acid, n-octenylsuccinic acid, n-dodecenylsuccinic acid, and isododecenylsuccinic acid.

Examples of tri- or higher-basic carboxylic acids that can be used include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

One alcohol may be used independently, or two or more alcohols may be used in combination. One carboxylic acid may be used independently, or two or more carboxylic acids may be used in combination. Furthermore, an ester-forming derivative of a carboxylic acid may be used. Examples of ester-forming derivatives that can be used include acid halide, acid anhydride, and lower alkyl ester. The term "lower alkyl" refers to an alkyl group having a carbon number of at least 1 and no greater than 6.

The polyester resin preferably has an acid value of at least 5 mgKOH/g and no greater than 30 mgKOH/g. The polyester resin preferably has a hydroxyl value of at least 15 mgKOH/g and no greater than 80 mgKOH/g, and more preferably at least 20 mgKOH/g and no greater than 60 mgKOH/g. As a result of the polyester resin having a hydroxyl value of at least 20 mgKOH/g, the shell layers are easily formed on the surfaces of the toner cores with portions of the respective magnetic particles embedded therein. As a result of the polyester resin having a hydroxyl value of no greater than 60 mgKOH/g, the shell layers can be restricted to a specific thickness, and charge stability of the toner can be kept high. The acid value and the hydroxyl value of the polyester resin are for example measured by a method prescribed by Japanese Industrial Standard (JIS) K0070-1992 or a method conforming therewith.

The acid value and the hydroxyl value of the polyester resin can for example be adjusted by appropriately adjusting the respective amounts of the alcohol and the carboxylic acid used in preparation of the polyester resin. An increase in molecular weight of the polyester resin tends to result in a decrease in the acid value and the hydroxyl value of the polyester resin.

The binder resin preferably has a softening point of at least 80° C. and no greater than 150° C. The binder resin preferably has a glass transition point of at least 30° C. and no greater than 60° C. As a result of the softening point and the glass transition point of the binder resin being within the above-specified ranges, preservability, shape retention, and durability of the toner are easily improved while also maintaining high fixability of the toner.

(Colorant)

The toner cores may contain a black colorant. The black colorant is for example a black pigment or a black dye. A specific example of the black pigment is carbon black. A black colorant that is adjusted to a black color using a yellow colorant, a magenta colorant, and a cyan colorant to be described later can be used.

(Releasing Agent)

The releasing agent is for example used in order to improve fixability of the toner or resistance of the toner to being offset. In order to improve fixability or offset resistance of the toner, the releasing agent is preferably contained in an amount of at least 1 part by mass and no greater than 30 parts by mass relative to 100 parts by mass of the binder resin, and more preferably at least 1 part by mass and no greater than 15 parts by mass.

Examples of releasing agents that can be used include aliphatic hydrocarbon waxes, oxides of aliphatic hydrocarbon waxes, plant waxes, animal waxes, mineral waxes, waxes having a fatty acid ester as a main component, and waxes in which a fatty acid ester is partially or fully deoxidized. Examples of aliphatic hydrocarbon waxes include ester wax, polyethylene wax (for example, low molecular weight polyethylene), polypropylene wax (for example, low molecular weight polypropylene), polyolefin copolymer, polyolefin wax, microcrystalline wax, paraffin wax, and Fischer-Tropsch wax. Examples of oxides of aliphatic hydrocarbon waxes include polyethylene oxide wax and block copolymer of polyethylene oxide. Examples of plant waxes include candelilla wax, carnauba wax, Japan wax, jojoba wax, and rice wax. Examples of animal waxes include beeswax, lanolin, and spermaceti. Examples of mineral waxes include ozokerite, ceresin, and petrolatum. Examples of waxes having a fatty acid ester as a main component include montanic acid ester wax and castor wax. Examples of waxes in which a fatty acid ester is partially or fully deoxidized include deoxidized carnauba wax. One releasing agent may be used independently, or two or more releasing agents may be used in combination.

<Shell Layers>

The shell layers preferably contain a thermosetting resin. The thermosetting resin contained in the shell layers are obtained through polymerization or copolymerization of a monomer of a thermosetting resin. As a result of the shell layers containing a thermosetting resin, the shell layers usually tend not to be ruptured upon application of heat and pressure to the toner during toner fixing. However, as described above, it is thought that the portion of each of the magnetic particles 13 that is located within the shell layers functions as a starting point of rupture of the shell layers upon application of heat and pressure to the toner according to the present embodiment during toner fixing. Even if the shell layers contain a thermosetting resin, therefore, the toner can have improved low-temperature fixability.

The thermosetting resin contained in the shell layers preferably has a cationic group. The thermosetting resin having a cationic group can be obtained through polymerization or copolymerization of a monomer having a cationic group. It should be noted here that the toner cores have a higher tendency to be anionic in an aqueous medium in a situation in which an anionic resin (for example, a resin having an ester bond or a hydroxyl group) is used as the binder resin. Since the surfaces of the toner cores with portions of the respective magnetic particles embedded therein are negatively chargeable, the toner cores having such surfaces are anionic in an aqueous medium. In a situation in which the monomer of the thermosetting resin has a cationic group, therefore, the cationic monomer of the thermosetting resin can be easily attracted toward the surfaces of the anionic particles (particles including the toner cores with portions of the respective magnetic particles embedded in the surfaces thereof) when the shell layers are formed using an aqueous medium. That is, the monomer of the thermosetting resin that is positively charged in an aqueous medium is readily electrically attracted toward the particles (particles including the toner cores with portions of the respective magnetic particles embedded in the surfaces thereof) that are negatively charged in the aqueous medium. Then, the shell layers are uniformly formed on the surfaces of the toner cores with portions of the respective magnetic particles embedded therein, through in-situ polymerization, for example. As a result, as described above, the toner particles can be uniformly charged, allowing the toner to have sharp charge distribution. Furthermore, occurrence of excessive charging can be inhibited even if images are formed continuously using the toner, thereby inhibiting reduction in image density of the images that are formed.

The cationic group of the thermosetting resin is for example a nitrogen-containing group (specific examples include —NH— and —N═). Examples of thermosetting resins having a cationic group include nitrogen-containing thermosetting resins. Examples of nitrogen-containing thermosetting resins include melamine resins, urea resins, and glyoxal resins, among which melamine resins are preferable.

A melamine resin is a polycondensate of melamine and formaldehyde. Therefore, melamine and formaldehyde are monomers for formation of the melamine resin. A urea resin is a polycondensate of urea and formaldehyde. Therefore, urea and formaldehyde are monomers for formation of the urea resin. A glyoxal resin is a polycondensate of formaldehyde and a reaction product of glyoxal and urea. Therefore, formaldehyde and a reaction product of glyoxal and urea are monomers for formation of the glyoxal resin.

A prepolymer of the thermosetting resin may be used to form the shell layers. For example, the melamine, the urea, and the reaction product of glyoxal and urea may be used in the form of a prepolymer (also referred to below as an initial polymer). The term "prepolymer" used herein refers to an intermediate product obtained by stopping polymerization of a monomer at a stage before the degree of polymerization reaches the degree of polymerization for a polymer.

The monomer of the thermosetting resin may be used in the form of a derivative to form the shell layers. For example, the melamine, the urea, or the urea caused to react with the glyoxal may be modified in a known manner. For example, the monomer of the thermosetting resin may be methylolated by formaldehyde prior to the reaction with the thermoplastic resin.

The term "a thermosetting resin material" may be used as a generic term for the above-mentioned monomer of the thermosetting resin, the above-mentioned prepolymer of the thermosetting resin, and the above-mentioned monomer of the thermosetting resin in the form of a derivative. The thermosetting resin material preferably has a cationic group, and more preferably a nitrogen-containing group (for example, —NH— or —N═). As a result of the thermosetting resin material having a cationic group, the thermosetting resin material that is positively charged in an aqueous medium is readily electrically attracted toward the particles (toner cores with portions of the respective magnetic particles embedded in the surfaces thereof) that are negatively charged in the aqueous medium. This facilitates in-situ polymerization of the thermosetting resin material on the surfaces of the toner cores with portions of the respective magnetic particles embedded therein.

Preferably, the thermosetting resin material has a functional group that is reactive with a functional group of the binder resin contained in the toner cores. For example, in a situation in which the binder resin is a polyester resin, the thermosetting resin material preferably has a hydroxyl group that is reactive with a hydroxyl group and a carboxyl group of the polyester resin.

<External Additive>

An external additive may be caused to adhere to the surfaces of the toner particles depending on necessity thereof. The term "toner mother particles" may be used to refer to the particles (toner particles) prior to treatment with the external additive.

Examples of external additives that can be used include metal oxides (for example, alumina, titanium oxide, magnesium oxide, zinc oxide, strontium titanate, and barium titanate), silicon carbide, and silica. Specific examples of silica include colloidal silica and hydrophobic silica. The external additive may be surface-treated with a surface treatment agent (for example, aminosilane, silicone oil, hexamethyldisilazane, a titanate coupling agent, or a silane coupling agent) as necessary.

The external additive preferably has a particle diameter of at least 0.01 μm and no greater than 1.00 μm. The external additive is preferably contained in an amount of at least 0.5 parts by mass and no greater than 10 parts by mass relative to 100 parts by mass of the toner mother particles, and more preferably at least 1 part by mass and no greater than 5 parts by mass.

[Composition of One-component Developer]

A one-component developer according to the present embodiment includes the toner according to the present embodiment. Accordingly, the use of the one-component developer according to the present embodiment in image formation provides the effects of improving low-temperature fixability, preventing occurrence of fogging, and improving developing properties in image formation in a low-humidity environment.

Preferably, the one-component developer contains inorganic fine particles as an external additive. The inorganic fine particles are preferably contained in an amount of at least 0.5 parts by mass and no greater than 2.0 parts by mass relative to 100.0 parts by mass of the toner particles. The inorganic fine particles may for example be hydrophobic silica. The hydrophobic silica is for example methoxy silane.

[Composition of Two-Component Developer]

A two-component developer according to the present embodiment includes the toner according to the present embodiment and a carrier for positively charging the toner through friction. Accordingly, the use of the two-component developer according to the present embodiment in image formation provides the effects of improving low-temperature fixability, preventing occurrence of fogging, and improving developing properties in image formation in a low-humidity environment. The following describes the carrier included in the two-component developer in further detail.

(Carrier)

The carrier is for example a carrier including carrier cores coated with a resin. The carrier cores are formed of magnetic particles. For another example, the carrier is a resin carrier including a resin and magnetic particles dispersed in the resin.

Specific examples of the magnetic particles include: particles of iron, oxidized iron, reduced iron, magnetite, copper, silicon steel, ferrite, nickel, or cobalt; particles of an alloy of any of the above materials with a metal such as manganese, zinc, or aluminum; particles of iron-nickel alloy; particles of iron-cobalt alloy; particles of a ceramic; and particles of a high-dielectric substance. Examples of ceramics that can be used for the particles include titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate. Examples of high-dielectric substances that can be used for the particles include ammonium dihydrogen phosphate, potassium dihydrogen phosphate, and Rochelle salt.

Examples of resins that can be used to coat the carrier cores or included in the resin carrier include acrylic acid-based polymers, styrene-based polymers, styrene-acrylic acid-based copolymers, olefin polymers (for example, polyethylene, chlorinated polyethylene, or polypropylene), polyvinyl chlorides, polyvinyl acetates, polycarbonates, cellulose resins, polyester resins, unsaturated polyester resins, polyamide resins, urethane resins, epoxy resins, silicone resins, fluororesins (for example, polytetrafluoroethylene, polychlorotrifluoroethylene, or polyvinylidene fluoride), phenolic resins, xylene resins, diallyl phthalate resins, polyacetal resins, and amino resins. Any one of the resins listed above may be used independently, or any two or more of the resins listed above may be used in combination.

The carrier preferably has a particle diameter of at least 20 μm and no greater than 120 μm, and more preferably at least 25 μm and no greater than 80 μm. The particle diameter of the carrier is for example measured using an electron microscope.

The toner is preferably contained in the two-component developer in an amount of at least 3% by mass and no greater than 20% by mass relative to mass of the two-component developer, and more preferably at least 5% by mass and no greater than 15% by mass.

[Example of Toner Production Method]

A method for producing the toner preferably includes a process of embedding portions of the respective magnetic particles in the surfaces of the toner cores and a process of forming the shell layers on the surfaces of the toner cores with the portions of the respective magnetic particles embedded therein. The method for producing the toner may include, as necessary, at least one of a magnetic powder formation process, a toner core formation process, a washing process, a drying process, and an external additive addition process.

<Magnetic Powder Formation Process>

(Magnetic Core Formation Process)

In a magnetic core formation process, an aqueous metal solution is heated under basic conditions. Air is bubbled through the heated aqueous metal solution. Through the above, the metal in the aqueous metal solution is oxidized. The oxidized metal is pulverized. As a result, magnetic cores are obtained.

Preferably, pH of the aqueous metal solution is adjusted to at least 12.0 and no greater than 13.0 using a basic substance for heating the aqueous metal solution. The heating temperature of the aqueous metal solution is preferably at least 70° C. and no greater than 100° C. The rate of bubbling of air through the aqueous metal solution is preferably at least 50 L/minute and no greater than 200 L/minute. The period of time of bubbling air through the aqueous metal solution is preferably at least 30 minutes and no greater than 600 minutes, and more preferably at least 200 minutes and no greater than 250 minutes. The oxidized metal is for example pulverized using a pulverizer (for example, "Hammer Mill (HM-5)", product of Nara Machinery Co., Ltd.).

The thus obtained magnetic cores may be subjected to at least one of washing, filtration, and drying as necessary.

(Surface Treatment Process)

In a surface treatment process, the surfaces of the magnetic cores are treated with a surface treatment agent. Through the above, the magnetic particles are obtained. The magnetic particles obtained through the surface treatment process each have a magnetic core and a coat layer coating the magnetic core. The coat layer that is formed contains the surface treatment agent or a hydrolysate of the surface treatment agent.

In a situation in which the surface treatment agent is an alkyl trialkoxysilane, a dialkyldialkoxysilane, a trialkylalkoxysilane, or an aryltrialkoxysilane, the treatment with the surface treatment agent is performed by mixing the surface treatment agent and the magnetic cores using, for example, a mixer (more specifically, a wheel kneader). The mixing time is preferably at least 5 minutes and no greater than 5 hours, and more preferably at least 30 minutes and no greater than 2 hours.

In a situation in which the surface treatment agent is a silicic acid compound, the treatment with the surface treatment agent is performed by immersing the magnetic cores in the surface treatment agent (for example, a silicic acid compound in a liquid form). Preferably, the immersing time is for example at least 0.1 seconds and no greater than 30 minutes. The immersing temperature is for example at least 0° C. and no greater than 50° C.

The magnetic cores immersed in the surface treatment agent may be heated as necessary. The heating temperature is preferably at least 100° C. and no greater than 300° C. The heating may be performed under reduced pressure.

The magnetic powder may be formed without performing such a surface treatment. That is, the magnetic cores may be used as the magnetic particles.

<Toner Core Formation Process>

The toner cores are for example formed by an aggregation method or a pulverization method. In a situation in which the toner cores are formed by the aggregation method, the toner core formation process for example includes an aggregation process and a coalescence process. The aggregation process involves causing fine particles including toner core components to aggregate in an aqueous medium to form aggregated particles. The coalescence process involves causing the components included in the aggregated particles to coalesce in the aqueous medium to form toner cores. In a situation in which the toner cores are formed by the aggregation method, it tends to be easier to obtain toner cores that are uniform in terms of shape and particle diameter.

In a situation in which the toner cores are formed by the pulverization method, the toner core formation process for example includes a mixing process, a kneading process, a pulverizing process, and a classifying process. The mixing process involves mixing a binder resin, a colorant, and a releasing agent to yield a mixture. The kneading process involves melting and kneading the resultant mixture to yield a melt-knead. The pulverizing process involves pulverizing the resultant melt-knead to yield a pulverized product. The classifying process involves classifying the pulverized product to yield toner cores. It is relatively easy to prepare the toner cores through the pulverization method. In the shell layer formation process described further below, the toner cores tend to be spheroidized due to slight softening of the toner cores through heating and contraction of the slightly softened toner cores by surface tension. It is therefore easy to increase the average roundness of the toner particles even in a situation in which the toner cores are formed by the pulverization method.

<Magnetic Particle Embedding Process>

Portions of the respective magnetic particles are embedded in the surfaces of the toner cores. Preferably, portions of the respective magnetic particles are mechanically embedded in the surfaces of the toner cores. One example of a method for embedding portions of the respective magnetic particles in the surfaces of the toner cores include a method involving mixing the toner cores and the magnetic particles using a mixer (for example, Hybridization System (registered Japanese trademark)). Mixing of the toner cores and the magnetic particles using the Hybridization System generates impact force of collision between the toner cores and the magnetic particles. As a result, portions of the respective magnetic particles are embedded in the surfaces of the toner cores.

Preferably, mixing conditions are set such that portions of the respective magnetic particles are embedded in the surfaces of the toner cores. For example, the speed of rotation using the Hybridization System is preferably at least 2,000 rpm and no greater than 5,000 rpm, and the time of mixing using the Hybridization System is preferably at least 2 minutes and no greater than 13 minutes. As a result of the speed of rotation using the Hybridization System being at least 2,000 rpm, impact force of collision between the toner cores and the magnetic particles is easily generated, thereby allowing portions of the respective magnetic particles to be readily embedded in the surfaces of the toner cores. The same effect is produced as a result of the time of mixing using the Hybridization System being at least 2 minutes.

As a result of the speed of rotation using the Hybridization System being no greater than 5,000 rpm, impact force of collision between the toner cores and the magnetic particles is restricted to a specific level, thereby preventing the magnetic particles from being completely embedded in the surfaces of the toner cores. The same effect is produced as a result of the time of mixing using the Hybridization System being no greater than 13 minutes.

Preferably, the magnetic particles are added in an amount of at least 0.50 parts by mass and no greater than 3.00 parts by mass relative to 100.00 parts by mass of the toner cores.

<Shell Layer Formation Process>

The shell layer formation process involves forming the shell layers on the surfaces of the toner cores with portions of the respective magnetic particles embedded therein. Preferably, the toner cores with portions of the respective magnetic particles embedded in the surfaces thereof are dispersed in an liquid containing a material of the shell layers, and polymerization or copolymerization of the material of the shell layers is caused on the surfaces of the toner cores.

Shell layer formation is preferably performed in an aqueous medium. The use of an aqueous medium prevents the binder resin from eluting in the solvent used for shell layer formation. The use of an aqueous medium also prevents a component of the toner cores (for example, a releasing agent) from eluting in the solvent used for shell layer formation. Furthermore, shell layer formation is preferably performed in an aqueous medium containing a dispersant. Examples of dispersants that can be used include sodium p-toluenesulfonate and sodium polyacrylate.

The aqueous medium is a medium in which water is a main component. The aqueous medium may function as a solution medium or a dispersion medium. Specific examples of aqueous mediums that can be used include water and a liquid mixture of water and a polar medium. Examples of polar mediums that can be contained in the aqueous medium include methanol and ethanol. Water is preferably contained in the aqueous medium in an amount of at least 70% by mass relative to mass of the aqueous medium, more preferably at least 80% by mass, still more preferably at least 90% by mass, and most preferably 100% by mass.

Examples of dispersing methods include a method that involves using a device capable of vigorous stirring of a dispersion to mechanically disperse in an aqueous medium the toner cores with portions of the respective magnetic particles embedded in the surfaces thereof. Examples of devices capable of vigorous stirring of a dispersion that can be used include a mixer (specific examples include "HIVIS MIX (registered Japanese trademark)", product of PRIMIX Corporation).

The aqueous medium containing the material of the thermosetting resin is preferably adjusted to approximately pH 4 using an acidic substance prior to addition of the toner cores with portions of the respective magnetic particles embedded in the surfaces thereof to the aqueous medium. Adjusting the aqueous medium to an acidic pH promotes a polycondensation reaction of the material of the thermosetting resin. It is preferable that the toner cores with portions of the respective magnetic particles embedded in the surfaces thereof are anionic in the aqueous medium at pH 4. It is therefore thought that ionization and elution in the aqueous medium at pH 4 of some of the metal contained in the magnetic particles in such toner cores can be restricted. As a result, shell layers tend to be readily formed in a uniform manner on the surfaces of the toner cores with portions of the respective magnetic particles embedded therein.

After adjustment of pH of the aqueous medium as necessary, the material of the thermosetting resin and the toner cores with portions of the respective magnetic particles embedded in the surfaces thereof are mixed in the aqueous medium. Through the above, an aqueous dispersion of the toner cores with portions of the respective magnetic particles embedded in the surfaces thereof is obtained. In the thus obtained aqueous dispersion, a polymerization reaction of the material of the thermosetting resin is promoted on the surfaces of the toner cores with portions of the respective magnetic particles embedded therein.

The temperature of the aqueous medium for shell layer formation is preferably at least 40° C. and no greater than 95° C., and more preferably at least 50° C. and no greater than 80° C. As a result of the temperature of the aqueous medium being in such a temperature range, shell layer formation readily proceeds.

The temperature of shell layer formation on the surfaces of the toner cores with portions of the respective magnetic particles embedded therein is preferably at least 40° C. and no greater than 95° C., and more preferably at least 50° C. and no greater than 80° C. Within such a temperature range, shell layer formation favorably proceeds.

The shell layers are formed so as to cover the surfaces of the respective toner cores with portions of the magnetic particles embedded therein. Through the above, an aqueous dispersion containing toner mother particles is obtained. The aqueous dispersion containing the toner mother particles is cooled to room temperature. Thereafter, at least one process selected from a washing process, a drying process, and an external additive addition process, which are described below, of the toner mother particles is performed as necessary. As a result, a toner including toner particles is obtained.

In a situation in which shell layers containing a melamine resin is formed, it is preferable to use an aqueous solution of a monomer of the melamine resin and polyacrylamide in ion exchanged water. The use of such an aqueous solution for shell layer formation restricts the hardness of resultant shell layers to a low level compared to the use of an aqueous solution containing no polyacrylamide. As a result, shell layers having a thickness of at least 10 nm and no greater than 50 nm can be formed.

<Washing Process>

The toner mother particles are washed using water as necessary. For example, the toner mother particles are washed by a method involving collecting a wet cake of the toner mother particles from the aqueous dispersion containing the toner mother particles through solid-liquid separation (for example, filtration) and washing the collected wet cake using water. For another example, the toner mother particles are washed by a method involving causing sedimentation of the toner mother particles in the dispersion, substituting a supernatant with water, and re-dispersing the toner mother particles in the water after the substitution.

<Drying Process>

The toner mother particles may be dried as necessary. For example, the toner mother particles are dried by a method involving using a dryer. Examples of driers that can be used include a spray dryer, a fluidized bed dryer, a vacuum freeze dryer, and a reduced pressure dryer. Use of a spray dryer is preferable in terms of inhibiting aggregation of the toner mother particles during drying. The spray dryer can be used to cause an external additive, such as silica, to adhere to the surfaces of the toner mother particles while drying the toner mother particles by spraying a dispersion of the external additive with the dispersion of the toner mother particles.

<External Additive Addition Process>

An external additive may be caused to adhere to the surfaces of the toner mother particles as necessary. An example of a process for causing an external additive to adhere to the surfaces of the toner mother particles involves mixing the toner mother particles and the external additive using a mixer (for example, an FM mixer or a Nauta mixer (registered Japanese trademark)), wherein conditions are set such that the external additive does not become embedded in the surface of the toner mother particles.

The toner production method can be altered in accordance with desired properties of the toner. Furthermore, non-essential procedures and processes may be omitted. In a situation in which the external additive addition process is omitted, the toner mother particles are equivalent to the toner particles.

[Example of One-component Developer Production Method]

Preferably, a production method of a one-component developer includes a process of externally adding inorganic particulates to the toner obtained as described above.

[Example of Two-Component Developer Production Method]

Preferably, a production method of a two-component developer includes a process of mixing the toner obtained as described above and a carrier.

EXAMPLES

The following describes Examples of the present disclosure. However, the present disclosure is in no way limited to the Examples.

Two-component developers D-1 to D-12 shown in Table 1 were produced in accordance with methods described below.

TABLE 1

| Two-component Developer | | | | | | | | | | |
|---|---|---|---|---|---|---|---|---|---|---|
| Toner | | | | | | | | | | |
| | | Magnetic powder | | | | Mixing conditions | | Shell layer | | |
| Type | Type | Type | X (nm) | Shape | Content | Speed (rpm) | Time (minute) | Type | Y (nm) | Z (nm) |
| D-1 | T-1 | A | 190 | Hexahedral | 1.0 | 5000 | 5 | S-1 | 10 | 20 |
| D-2 | T-2 | A | 190 | Hexahedral | 1.0 | 2000 | 3 | S-2 | 50 | 80 |
| D-3 | T-3 | A | 190 | Hexahedral | 1.0 | 5000 | 5 | S-3 | 5 | 20 |
| D-4 | T-4 | B | 200 | Octahedral | 1.0 | 5000 | 5 | S-1 | 10 | 20 |
| D-5 | T-5 | C | 220 | Spherical | 1.0 | 5000 | 5 | S-1 | 10 | 20 |
| D-6 | T-6 | D | 100 | Hexahedral | 1.0 | 4000 | 3 | S-1 | 10 | 10 |
| D-7 | T-7 | E | 300 | Hexahedral | 1.0 | 5000 | 3 | S-1 | 10 | 80 |
| D-8 | T-8 | A | 190 | Hexahedral | 0.5 | 5000 | 5 | S-1 | 10 | 20 |
| D-9 | T-9 | A | 190 | Hexahedral | 3.0 | 5000 | 5 | S-1 | 10 | 20 |
| D-10 | T-10 | A | 190 | Hexahedral | 1.0 | 5000 | 5 | S-4 | 90 | 20 |
| D-11 | T-11 | A | 190 | Hexahedral | 1.0 | 2000 | 1 | S-1 | 10 | 100 |
| D-12 | T-12 | A | 190 | Hexahedral | 1.0 | 5000 | 15 | S-1 | 10 | 0 |

In Table 1, "X" indicates the average Heywood diameter X of the magnetic particles included in the magnetic powder, "Y" indicates the shell layer thickness Y, and "Z" indicates the average value Z of protrusion heights of the magnetic particles included in the magnetic powder.

"Content" indicates the amount (unit: parts by mass) of the magnetic powder contained relative to 100 parts by mass of the toner cores.

"Mixing conditions" indicate conditions of mixing of the toner cores and the magnetic powder using Hybridization System. "Speed" under "Mixing conditions" indicates a speed of rotation using Hybridization System, and "Time" indicates a period of time of mixing.

[Production of Magnetic Powder A]

First, magnetic cores were formed. More specifically, 20 L of an aqueous ferrous sulfate solution having an iron ion ($Fe^{2+}$) concentration of 1.5 mol/L and 10 L of a 20 mol/L aqueous sodium hydroxide solution were mixed. The liquid mixture was heated up to 90° C. to yield an aqueous ferrous salt solution at pH 9 containing ferrous hydroxide ($Fe(OH)_2$). The temperature of the thus obtained aqueous solution was adjusted to 90° C. and air was bubbled through the aqueous solution at a rate of 100 L/minute for 120 minutes. Through the above, the ferrous hydroxide was oxidized to yield a magnetic powder (magnetite). The aqueous solution was adjusted to pH 8 through addition of an aqueous sulfuric acid solution to the aqueous solution. As describe above, an aqueous ferrous salt solution containing the magnetic powder (magnetite) was obtained.

Next, a 20 mol/L aqueous sodium hydroxide solution was added to the aqueous ferrous salt solution containing the magnetic powder (magnetite) thereby to adjust the aqueous solution to pH 9. The temperature of the thus obtained aqueous solution was adjusted to 90° C. and air was bubbled through the aqueous solution at a rate of 100 L/minute for 60 minutes. Through the above, the magnetic powder was obtained. The thus obtained magnetic powder was washed with water, filtered off, and dried. The dried magnetic powder was pulverized using a pulverizer ("Hammer Mill (HM-5)", product of Nara Machinery Co., Ltd.) to yield magnetic cores for the magnetic powder A.

Next, the magnetic cores and 300 parts by mass of ion exchanged water relative to 100 parts by mass of the magnetic cores were mixed using a homo mixer ("Homo-mixer MARK II Model 2.5", product of PRIMIX Corporation). Thus, an aqueous dispersion containing the magnetic cores was obtained. The aqueous dispersion was adjusted to pH 4 through addition of hydrochloric acid to the aqueous dispersion. To the aqueous dispersion, 2 parts by mass of methoxy silane (coupling agent, "Z-6030", product of Dow Corning Toray Co., Ltd.) relative to 100 parts by mass of the magnetic core contained in the aqueous dispersion was added, followed by mixing. Thus, a coupling reaction of the resultant mixture was caused. As a result, coat layers were formed so as to cover the respective magnetic cores. The coat layers contained methoxy silane serving as a surface treatment agent. Next, the magnetic cores coated with the coat layers were filtered off and dried. Through the above, the magnetic powder A was obtained.

[Production of Magnetic Powder B]

The magnetic powder B was produced according to the same method as the production of the magnetic powder A in all aspects other than that magnetic cores for the magnetic powder B were produced according to the method described below.

That is, 20 L of an aqueous ferrous sulfate solution having an iron ion ($Fe^{2+}$) concentration of 1.5 mol/L and 10 L of a 30 mol/L aqueous sodium hydroxide solution were mixed. The liquid mixture was heated up to 90° C. to yield an aqueous ferrous salt solution at pH 12.5 containing ferrous hydroxide ($Fe(OH)_2$). The temperature of the thus obtained aqueous solution was adjusted to 90° C. and air was bubbled through the aqueous solution at a rate of 100 L/minute for 120 minutes. Through the above, the ferrous hydroxide was oxidized to yield a magnetic powder (magnetite). The aqueous solution was adjusted to pH 8 through addition of an aqueous sulfuric acid solution to the aqueous solution. As describe above, an aqueous ferrous salt solution containing the magnetic powder (magnetite) was obtained.

Next, a 30 mol/L aqueous sodium hydroxide solution was added to the aqueous ferrous salt solution containing the magnetic powder (magnetite) thereby to adjust the aqueous solution to pH 10. The temperature of the thus obtained aqueous solution was adjusted to 90° C. and air was bubbled through the aqueous solution at a rate of 100 L/minute for 60 minutes. Through the above, the magnetic powder was obtained. The thus obtained magnetic powder was washed with water, filtered off, and dried. The dried magnetic powder was pulverized using a pulverizer ("Hammer Mill (HM-5)", product of Nara Machinery Co., Ltd.) to yield magnetic cores for the magnetic powder B.

[Production of Magnetic Powder C]

The magnetic powder C was produced according to the same method as the production of the magnetic powder A in all aspects other than that magnetic cores for the magnetic powder C were produced according to the method described below.

That is, 20 L of an aqueous ferrous sulfate solution having an iron ion ($Fe^{2+}$) concentration of 1.5 mol/L and 10 L of a 10 mol/L aqueous sodium hydroxide solution were mixed. The liquid mixture was heated up to 100° C. to yield an aqueous ferrous salt solution at pH 6.7 containing ferrous hydroxide ($Fe(OH)_2$). The temperature of the thus obtained aqueous solution was adjusted to 100° C. and air was bubbled through the aqueous solution at a rate of 100 L/minute for 120 minutes. Through the above, the ferrous hydroxide was oxidized to yield a magnetic powder (magnetite). The aqueous solution was adjusted to pH 6 through addition of an aqueous sulfuric acid solution to the aqueous solution. As describe above, an aqueous ferrous salt solution containing the magnetic powder (magnetite) was obtained.

Next, a 10 mol/L aqueous sodium hydroxide solution was added to the aqueous ferrous salt solution containing the magnetic powder (magnetite) thereby to adjust the aqueous solution to pH 10. The temperature of the thus obtained aqueous solution was adjusted to 90° C. and air was bubbled through the aqueous solution at a rate of 100 L/minute for 60 minutes. Through the above, the magnetic powder was obtained. The thus obtained magnetic powder was washed with water, filtered off, and dried. The dried magnetic powder was pulverized using a pulverizer ("Hammer Mill (HM-5)", product of Nara Machinery Co., Ltd.) to yield magnetic cores for the magnetic powder C.

[Production of Magnetic Powder D]

The magnetic powder D was produced according to the same method as the production of the magnetic powder A in all aspects other than that magnetic cores for the magnetic powder D were produced according to the method described below.

That is, 20 L of an aqueous ferrous sulfate solution having an iron ion ($Fe^{2+}$) concentration of 1.5 mol/L and 10 L of a 15 mol/L aqueous sodium hydroxide solution were mixed. The liquid mixture was heated up to 80° C. to yield an aqueous ferrous salt solution at pH 9 containing ferrous hydroxide ($Fe(OH)_2$). The temperature of the thus obtained aqueous solution was adjusted to 80° C. and air was bubbled through the aqueous solution at a rate of 100 L/minute for 30 minutes. Through the above, the ferrous hydroxide was oxidized to yield a magnetic powder (magnetite). The aqueous solution was adjusted to pH 8 through addition of an aqueous sulfuric acid solution to the aqueous solution. As describe above, an aqueous ferrous salt solution containing the magnetic powder (magnetite) was obtained.

Next, a 15 mol/L aqueous sodium hydroxide solution was added to the aqueous ferrous salt solution containing the magnetic powder (magnetite) thereby to adjust the aqueous solution to pH 9. The temperature of the thus obtained aqueous solution was adjusted to 90° C. and air was bubbled through the aqueous solution at a rate of 100 L/minute for 120 minutes. Through the above, the magnetic powder was obtained. The thus obtained magnetic powder was washed with water, filtered off, and dried. The dried magnetic powder was pulverized using a pulverizer ("Hammer Mill (HM-5)", product of Nara Machinery Co., Ltd.) to yield magnetic cores for the magnetic powder D.

[Production of Magnetic Powder E]

The magnetic powder E was produced according to the same method as the production of the magnetic powder A in all aspects other than that magnetic cores for the magnetic powder E were produced according to the method described below.

That is, 20 L of an aqueous ferrous sulfate solution having an iron ion ($Fe^{2+}$) concentration of 1.5 mol/L and 10 L of a 20 mol/L aqueous sodium hydroxide solution were mixed. The liquid mixture was heated up to 100° C. to yield an aqueous ferrous salt solution at pH 9 containing ferrous hydroxide ($Fe(OH)_2$). The temperature of the thus obtained aqueous solution was adjusted to 100° C. and air was bubbled through the aqueous solution at a rate of 100 L/minute for 220 minutes. Through the above, the ferrous hydroxide was oxidized to yield a magnetic powder (magnetite). The thus obtained magnetic powder was washed with water, filtered off, and dried. The dried magnetic powder was pulverized using a pulverizer ("Hammer Mill (HM-5)", product of Nara Machinery Co., Ltd.) to yield magnetic cores for the magnetic powder E.

[Measurement of Physical Properties of Magnetic Powders A to E]

With respect to each of the magnetic powders A to E, the shape and the average Heywood diameter X of the magnetic particles included in the magnetic powder was measured according to the method described below. Table 1 shows the measurement results.

A measurement sample (magnetic powder) was observed at a magnification of ×50,000 using a scanning electron microscope (SEM, "JSM-880", product of JEOL Ltd.). From among the magnetic particles included in the measurement sample, 300 magnetic particles were randomly selected, and an SEM image of each of the magnetic particles was captured. The shape of the magnetic particle was confirmed from the SEM image. Furthermore, with respect to each of the 300 magnetic particles, the SEM image of the magnetic particle was subjected to image analysis using an image analyzer to measure a Heywood diameter thereof. A sum of all the Heywood diameters measured was divided by the number of magnetic particles (300). Through the above, the average Heywood diameter (number average Heywood diameter) X of the magnetic particles was determined.

[Production of Toner T-1]

(Production of Toner Cores Tc)

First, a polyester resin was prepared. More specifically, 1,500 g of terephthalic acid, 1,500 g of isophthalic acid, 1,200 g of bisphenol A ethylene oxide adduct, and 800 g of ethylene glycol were added to a four-necked flask (capacity: 5 L). Next, a nitrogen atmosphere was maintained in the flask, and the internal temperature of the flask was raised up to 250° C. while the contents of the flask were stirred. The flask contents were caused to react for 4 hours at 250° C. under standard pressure.

Next, 0.8 g of antimony trioxide, 0.5 g of triphenyl phosphate, and 0.1 g of tetrabutyl titanate were added to the flask. The internal pressure of the flask was reduced to 0.3 mmHg, and the internal temperature of the flask was raised up to 280° C. Subsequently, the flask contents were caused to react for 6 hours.

Next, 30.0 g of trimellitic acid (cross-linking agent) was added to the flask. The internal pressure of the flask was returned to standard pressure, and the internal temperature of the flask was decreased to 230° C. Subsequently, the flask contents were caused to react for 1 hour. After completion of the reaction, a reaction product was taken out from the flask and cooled. Through the above, the polyester resin was obtained. The thus obtained polyester resin had a glass transition point of 53.8° C., a softening point of 100.5° C., a number average molecular weight (Mn) of 1,460, a molecular weight distribution (Mw/Mn) of 12.7, an acid value of 16.8 mgKOH/g, and a hydroxyl value of 22.8 mgKOH/g.

Into an FM mixer ("FM-20B", product of Nippon Coke & Engineering Co., Ltd), 90 parts by mass of the polyester resin, 5 parts by mass of carbon black ("MA100", product of Mitsui Chemicals, Inc.), and 5 parts by mass of carnauba wax ("Special Refined Carnauba Wax (Tokusei) No. 1", product of S. Kato & Co.) were added, and then mixed at a rotational speed of 2,400 rpm for 180 seconds. The resultant mixture was melt-kneaded using a two-axis extruder ("PCM-30", product of Ikegai Corp.) (material feeding speed: 5 kg/hour, shaft rotation speed: 150 rpm, cylinder temperature: 150° C.). The resultant kneaded product was cooled, and subsequently roughly pulverized using a pulverizer ("Rotoplex (registered Japanese trademark)", product of Hosokawa Micron Corporation) and finely pulverized using an impact plate pulverizer ("Model-I Super Sonic Jet Mill", product of Nippon Pneumatic Mfg.). The resultant finely pulverized product was classified using a classifier ("Elbow Jet EJ-LABO", product of Nittetsu Mining Co., Ltd.). Through the above, the toner cores Tc having a volume median diameter ($D_{50}$) of 8.0 m were obtained.

(Embedding of Magnetic Powder A in Surfaces of Toner Cores Tc: Production of Particles TcA-1)

Into an FM mixer ("FM-20B", product of Nippon Coke & Engineering Co., Ltd), 100.0 parts by mass of the toner cores Tc and 1.0 parts by mass of the magnetic powder A were added, and the mixed for 5 minutes (rotational speed: 800 rpm). The resultant mixture was loaded into Hybridization System ("NHS—O", product of Nara Machinery Co., Ltd.) and mixed for 5 minutes (rotational speed: 5,000 rpm, circulating gas flow temperature: 10° C.). As a result, portions of the respective magnetic particles included in the magnetic powder A were embedded in the surfaces of the toner cores Tc. The thus obtained particles were sifted using a 200-mesh sieve (opening: 75 m). The particles TcA-1 that passed through the sieve were used to produce the toner T-1.

(Shell Layer Formation)

Into a three-necked flask (capacity: 1 L) equipped with a thermometer and a stirring impeller, 300 mL of ion exchanged water was added. The internal temperature of the flask was maintained at 30° C. using a water bath ("IWB-250" sold by AS ONE Corporation). The liquid in the flask was adjusted to pH 4 through addition of dilute hydrochloric acid to the flask. Into the flask, 1 mL of an aqueous methylol melamine solution (a shell layer material, "MIRBANE (registered Japanese trademark) RESIN SM-607", product of Showa Denko K.K.) and 1 mL of an aqueous polyacrylamide solution (a shell layer material, product of Wako Pure Chemical Industries, Ltd., polyacrylamide concentration: 10% by mass) were added. The shell layer materials were dissolved in 300 mL of ion exchanged water through stirring of the flask contents. Through the above, a shell layer material-containing aqueous solution S-1 was obtained.

To the shell layer material-containing aqueous solution S-1, 300 g of the particles TcA-1 were added. The flask contents were stirred at a rotational speed of 200 rpm for 1 hour. To the flask, 500 mL of ion exchanged water and 3 mL of an aqueous sodium p-toluenesulfonate solution (product of Tokyo Chemical Industry Co., Ltd.) were further added. The internal temperature of the flask was raised up to 70° C. at a rate of 1° C./minute while the flask contents were stirred at a rotational speed of 100 rpm. The flask contents were stirred at a rotational speed of 100 rpm for 2 hours while the internal temperature of the flask was maintained at 70° C. The flask contents were adjusted to pH 7 through addition of sodium hydroxide to the flask. Next, the flask contents were cooled to room temperature. Through the above, shell layers (melamine resin) covering surfaces of the respective toner cores Tc were formed. As described above, a dispersion of toner mother particles was obtained.

(Washing)

The dispersion of the toner mother particles obtained as described above was filtered using a Buchner funnel to obtain a wet cake of the toner mother particles. The wet cake of the toner mother particles was dispersed in ion exchanged water. Through the above, the toner mother particles were washed. Washing of the toner mother particles with ion exchanged water in the same manner was repeated five times.

(Drying)

A wet cake of the washed toner mother particles was dispersed in a 50% by mass aqueous ethanol solution. The resultant slurry was supplied into a continuous type surface modifier ("Coatmizer (registered Japanese trademark)", product of Freund Corporation) to dry the toner mother particles in the slurry. The drying using Coatmizer was carried out under conditions of a hot air temperature of 45° C. and a blower flow rate of 2 $m^3$/minute.

(External Additive)

Into an FM mixer ("FM-10B", product of Nippon Coke & Engineering Co., Ltd., capacity: 10 L), 100.0 parts by mass of the dried toner mother particles and 0.5 parts by mass of positively chargeable silica particles ("AEROSIL (registered Japanese trademark) REA90", product of Nippon Aerosil Co., Ltd.) were added, and then mixed for 5 minutes. The mixing caused the external additive to adhere to the surfaces of the toner mother particles. The thus obtained particles were sifted using a 200-mesh sieve. Through the above, the toner T-1 was obtained.

[Production of Toner T-2]

The toner T-2 was produced according to the same method as the production of the toner T-1 in all aspects other than that portions of the respective magnetic particles included in the magnetic powder A were embedded in the surfaces of the toner cores Tc according to the method described below (Embedding of Magnetic Powder A in Surfaces of Toner Cores Tc: Production of Particles TcA-2) and the dispersion of the toner mother particles was prepared according to the method described below (Shell Layer Formation).

(Embedding of Magnetic Powder A in Surfaces of Toner Cores Tc: Production of Particles TcA-2)

Into an FM mixer ("FM-20B", product of Nippon Coke & Engineering Co., Ltd), 100.0 parts by mass of the toner cores Tc and 1.0 parts by mass of the magnetic powder A were added, and then mixed for 5 minutes (rotational speed: 800 rpm). The resultant mixture was loaded into Hybridization System ("NHS—O", product of Nara Machinery Co., Ltd.) and mixed for 3 minutes (rotational speed: 2,000 rpm, circulating gas flow temperature: 10° C.). As a result, portions of the respective magnetic particles included in the magnetic powder A were embedded in the surfaces of the toner cores Tc. The thus obtained particles were sifted using a 200-mesh sieve. The particles TcA-2 that passed through the sieve were used to produce the toner T-2.

(Shell Layer Formation)

Into a three-necked flask (capacity: 1 L) equipped with a thermometer and a stirring impeller, 300 mL of ion exchanged water was added. The internal temperature of the flask was maintained at 30° C. using a water bath ("IWB-250" sold by AS ONE Corporation). The liquid in the flask was adjusted to pH 4 through addition of dilute hydrochloric acid to the flask. Into the flask, 5 mL of an aqueous methylol urea solution (a shell layer material, "MX-280", product of Nippon Carbide Industries Co., Inc.) and 2 mL of an aqueous polyacrylamide solution (a shell layer material, product of Wako Pure Chemical Industries, Ltd., polyacrylamide concentration: 10% by mass) were further added. The shell layer materials were dissolved in 300 mL of ion exchanged water through stirring of the flask contents. Through the above, a shell layer material-containing aqueous solution S-2 was obtained.

To the shell layer material-containing aqueous solution S-2, 300 g of the particles TcA-2 were added. The flask contents were stirred at a rotational speed of 200 rpm for 1 hour. To the flask, 500 mL of ion exchanged water and 3 mL of an aqueous sodium p-toluenesulfonate solution (product of Tokyo Chemical Industry Co., Ltd.) were further added. The internal temperature of the flask was raised up to 70° C. at a rate of 1° C./minute while the flask contents were stirred at a rotational speed of 100 rpm. The flask contents were stirred at a rotational speed of 100 rpm for 2 hours while the internal temperature of the flask was maintained at 70° C. The flask contents were adjusted to pH 7 through addition of sodium hydroxide to the flask. Next, the flask contents were cooled to room temperature. Through the above, shell layers (melamine resin) covering surfaces of the respective toner cores Tc were formed. As described above, a dispersion of toner mother particles (a dispersion of toner mother particles for the toner T-2) was obtained.

[Production of Toner T-3]

The toner T-3 was produced according to the same method as the production of the toner T-1 in all aspects other than that a dispersion of toner mother particles was prepared according to the method described below (Shell Layer Formation).

(Shell Layer Formation)

Into a three-necked flask (capacity: 1 L) equipped with a thermometer and a stirring impeller, 300 mL of ion exchanged water was added. The internal temperature of the flask was maintained at 30° C. using a water bath ("IWB-250" sold by AS ONE Corporation). Next, the liquid in the flask was adjusted to pH 4 through addition of dilute hydrochloric acid to the flask. Into the flask, 0.5 mL of an aqueous methylol melamine solution (a shell layer material, "MIRBANE RESIN SM-607", product of Showa Denko K.K.) and 1 mL of an aqueous polyacrylamide solution (a shell layer material, product of Wako Pure Chemical Industries, Ltd., polyacrylamide concentration: 10% by mass) were further added. The shell layer materials were dissolved in 300 mL of ion exchanged water through stirring of the flask contents. Through the above, a shell layer material-containing aqueous solution S-3 was obtained.

To the shell layer material-containing aqueous solution S-3, 300 g of the particles TcA-1 were added. The flask contents were stirred at a rotational speed of 200 rpm for 1 hour. To the flask, 500 mL of ion exchanged water and 3 mL of an aqueous sodium p-toluenesulfonate solution (product of Tokyo Chemical Industry Co., Ltd.) were further added. The internal temperature of the flask was raised up to 70° C. at a rate of 1° C./minute while the flask contents were stirred at a rotational speed of 100 rpm. The flask contents were stirred at a rotational speed of 100 rpm for 2 hours while the internal temperature of the flask was maintained at 70° C. The flask contents were adjusted to pH 7 through addition of sodium hydroxide to the flask. Next, the flask contents were cooled to room temperature. Through the above, shell layers (melamine resin) covering surfaces of the respective toner cores Tc were formed. As described above, a dispersion of toner mother particles (a dispersion of toner mother particles for the toner T-3) was obtained.

[Production of Toner T-4]

The toner T-4 was produced according to the same method as the production of the toner T-1 in all aspects other than that portions of the respective magnetic particles included in the magnetic powder B were embedded in the surfaces of the toner cores Tc according to the method described below (Embedding of Magnetic Powder B in Surfaces of Toner Cores Tc: Production of Particles TcB-1).

(Embedding of Magnetic Powder B in Surfaces of Toner Cores Tc: Production of Particles TcB-1)

Into an FM mixer ("FM-20B", product of Nippon Coke & Engineering Co., Ltd), 100.0 parts by mass of the toner cores Tc and 1.0 parts by mass of the magnetic powder B were added, and then mixed for 5 minutes (rotational speed: 800 rpm). The resultant mixture was loaded into Hybridization System ("NHS—O", product of Nara Machinery Co., Ltd.) and mixed for 5 minutes (rotational speed: 5,000 rpm, circulating gas flow temperature: 10° C.). As a result, portions of the respective magnetic particles included in the magnetic powder B were embedded in the surfaces of the toner cores Tc. The thus obtained particles were sifted using a 200-mesh sieve. The particles TcB-1 that passed through the sieve were used to produce the toner T-4.

[Production of Toner T-5]

The toner T-5 was produced according to the same method as the production of the toner T-1 in all aspects other than that portions of the respective magnetic particles included in the magnetic powder C were embedded in the surfaces of the toner cores Tc according to the method described below (Embedding of Magnetic Powder C in Surfaces of Toner Cores Tc: Production of Particles TcC-1).

(Embedding of Magnetic Powder C in Surfaces of Toner Cores Tc: Production of Particles TcC-1)

Into an FM mixer ("FM-20B", product of Nippon Coke & Engineering Co., Ltd), 100.0 parts by mass of the toner cores Tc and 1.0 parts by mass of the magnetic powder C were added, and then mixed for 5 minutes (rotational speed: 800 rpm). The resultant mixture was loaded into Hybridization System ("NHS—O", product of Nara Machinery Co., Ltd.) and mixed for 5 minutes (rotational speed: 5,000 rpm, circulating gas flow temperature: 10° C.). As a result, portions of the respective magnetic particles included in the magnetic powder C were embedded in the surfaces of the toner cores Tc. The thus obtained particles were sifted using a 200-mesh sieve. The particles TcC-1 that passed through the sieve were used to produce the toner T-5.

[Production of Toner T-6]

The toner T-6 was produced according to the same method as the production of the toner T-1 in all aspects other than that portions of the respective magnetic particles included in the magnetic powder D were embedded in the surfaces of the toner cores Tc according to the method described below (Embedding of Magnetic Powder D in Surfaces of Toner Cores Tc: Production of Particles TcD-1).

(Embedding of Magnetic Powder D in Surfaces of Toner Cores Tc: Production of Particles TcD-1)

Into an FM mixer ("FM-20B", product of Nippon Coke & Engineering Co., Ltd), 100.0 parts by mass of the toner cores Tc and 1.0 parts by mass of the magnetic powder D were added, and then mixed for 5 minutes (rotational speed: 800 rpm). The resultant mixture was loaded into Hybridization System ("NHS—O", product of Nara Machinery Co., Ltd.) and mixed for 3 minutes (rotational speed: 4,000 rpm, circulating gas flow temperature: 10° C.). As a result, portions of the respective magnetic particles included in the magnetic powder D were embedded in the surfaces of the toner cores Tc. The thus obtained particles were sifted using a 200-mesh sieve. The particles TcD-1 that passed through the sieve were used to produce the toner T-6.

[Production of Toner T-7]

The toner T-7 was produced according to the same method as the production of the toner T-1 in all aspects other than that portions of the respective magnetic particles included in the magnetic powder E were embedded in the surfaces of the toner cores Tc according to the method described below (Embedding of Magnetic Powder E in Surfaces of Toner Cores Tc: Production of Particles TcE-1).

(Embedding of Magnetic Powder E in Surfaces of Toner Cores Tc: Production of Particles TcE-1)

Into an FM mixer ("FM-20B", product of Nippon Coke & Engineering Co., Ltd), 100.0 parts by mass of the toner cores Tc and 1.0 parts by mass of the magnetic powder E were added, and then mixed for 5 minutes (rotational speed: 800 rpm). The resultant mixture was loaded into Hybridization System ("NHS—O", product of Nara Machinery Co., Ltd.) and mixed for 3 minutes (rotational speed: 5,000 rpm, circulating gas flow temperature: 10° C.). As a result, portions of the respective magnetic particles included in the magnetic powder E were embedded in the surfaces of the toner cores Tc. The thus obtained particles were sifted using a 200-mesh sieve. The particles TcE-1 that passed through the sieve were used to produce the toner T-7.

[Production of Toner T-8]

The toner T-8 was produced according to the same method as the production of the toner T-1 in all aspects other than that portions of the respective magnetic particles included in the magnetic powder A were embedded in the surfaces of the toner cores Tc according to the method described below (Embedding of Magnetic Powder A in Surfaces of Toner Cores Tc: Production of Particles TcA-3).

(Embedding of Magnetic Powder A in Surfaces of Toner Cores Tc: Production of Particles TcA-3)

Into an FM mixer ("FM-20B", product of Nippon Coke & Engineering Co., Ltd), 100.0 parts by mass of the toner cores Tc and 0.5 parts by mass of the magnetic powder A were added, and then mixed for 5 minutes (rotational speed: 800 rpm). The resultant mixture was loaded into Hybridization System ("NHS—O", product of Nara Machinery Co., Ltd.) and mixed for 5 minutes (rotational speed: 5,000 rpm, circulating gas flow temperature: 10° C.). As a result, portions of the respective magnetic particles included in the magnetic powder A were embedded in the surfaces of the toner cores Tc. The thus obtained particles were sifted using a 200-mesh sieve. The particles TcA-3 that passed through the sieve were used to produce the toner T-8.

[Production of Toner T-9]

The toner T-9 was produced according to the same method as the production of the toner T-1 in all aspects other than that portions of the respective magnetic particles included in the magnetic powder A were embedded in the surfaces of the toner cores Tc according to the method described below (Embedding of Magnetic Powder A in Surfaces of Toner Cores Tc: Production of Particles TcA-4).

(Embedding of Magnetic Powder A in Surfaces of Toner Cores Tc: Production of Particles TcA-4)

Into an FM mixer ("FM-20B", product of Nippon Coke & Engineering Co., Ltd), 100.0 parts by mass of the toner cores Tc and 3.0 parts by mass of the magnetic powder A were added, and then mixed for 5 minutes (rotational speed: 800 rpm). The resultant mixture was loaded into Hybridization System ("NHS—O", product of Nara Machinery Co., Ltd.) and mixed for 5 minutes (rotational speed: 5,000 rpm, circulating gas flow temperature: 10° C.). As a result, portions of the respective magnetic particles included in the magnetic powder A were embedded in the surfaces of the toner cores Tc. The thus obtained particles were sifted using a 200-mesh sieve. The particles TcA-4 that passed through the sieve were used to produce the toner T-9.

[Production of Toner T-10]

The toner T-10 was produced according to the same method as the production of the toner T-1 in all aspects other than that a dispersion of toner mother particles was prepared according to the method described below (Shell Layer Formation).

(Shell Layer Formation)

Into a three-necked flask (capacity: 1 L) equipped with a thermometer and a stirring impeller, 300 mL of ion exchanged water was added. The internal temperature of the flask was maintained at 30° C. using a water bath ("IWB-250" sold by AS ONE Corporation). The liquid in the flask was adjusted to pH 4 through addition of dilute hydrochloric acid to the flask. Into the flask, 10 mL of an aqueous methylol urea solution (a shell layer material, "MX-280", product of Nippon Carbide Industries Co., Inc.) and 3 mL of an aqueous polyacrylamide solution (a shell layer material, product of Wako Pure Chemical Industries, Ltd., polyacrylamide concentration: 10% by mass) were further added. The shell layer materials were dissolved in 300 mL of ion exchanged water through stirring of the flask contents. Through the above, a shell layer material-containing aqueous solution S-4 was obtained.

To the shell layer material-containing aqueous solution S-4, 300 g of the particles TcA-1 were added. The flask contents were stirred at a rotational speed of 200 rpm for 1 hour. To the flask, 500 mL of ion exchanged water and 3 mL of an aqueous sodium p-toluenesulfonate solution (product of Tokyo Chemical Industry Co., Ltd.) were further added. The internal temperature of the flask was raised up to 70° C. at a rate of 1° C./minute while the flask contents were stirred at a rotational speed of 100 rpm. The flask contents were stirred at a rotational speed of 100 rpm for 2 hours while the internal temperature of the flask was maintained at 70° C. The flask contents were adjusted to pH 7 through addition of sodium hydroxide to the flask. Next, the flask contents were cooled to room temperature. Through the above, shell layers (melamine resin) covering surfaces of the respective toner cores Tc were formed. As described above, a dispersion of toner mother particles (a dispersion of toner mother particles for the toner T-10) was obtained.

[Production of Toner T-11]

The toner T-11 was produced according to the same method as the production of the toner T-1 in all aspects other than that portions of the respective magnetic particles included in the magnetic powder A were embedded in the surfaces of the toner cores Tc according to the method described below (Embedding of Magnetic Powder A in Surfaces of Toner Cores Tc: Production of Particles TcA-5).

(Embedding of Magnetic Powder A in Surfaces of Toner Cores Tc: Production of Particles TcA-5)

Into an FM mixer ("FM-20B", product of Nippon Coke & Engineering Co., Ltd), 100.0 parts by mass of the toner cores Tc and 1.0 parts by mass of the magnetic powder A were added, and then mixed for 5 minutes (rotational speed: 800 rpm). The resultant mixture was loaded into Hybridization System ("NHS—O", product of Nara Machinery Co., Ltd.) and mixed for 1 minute (rotational speed: 2,000 rpm, circulating gas flow temperature: 10° C.). As a result, portions of the respective magnetic particles included in the magnetic powder A were embedded in the surfaces of the toner cores Tc. The thus obtained particles were sifted using a 200-mesh sieve. The particles TcA-5 that passed through the sieve were used to produce the toner T-11.

[Production of Toner T-12]

The toner T-12 was produced according to the same method as the production of the toner T-1 in all aspects other than that portions of the respective magnetic particles included in the magnetic powder A were embedded in the surfaces of the toner cores Tc according to the method described below (Embedding of Magnetic Powder A in Surfaces of Toner Cores Tc: Production of Particles TcA-6).

(Embedding of Magnetic Powder A in Surfaces of Toner Cores Tc: Production of Particles TcA-6)

Into an FM mixer ("FM-20B", product of Nippon Coke & Engineering Co., Ltd), 100.0 parts by mass of the toner cores Tc and 1.0 parts by mass of the magnetic powder A were added, and then mixed for 5 minutes (rotational speed: 800 rpm). The resultant mixture was loaded into Hybridization System ("NHS—O", product of Nara Machinery Co., Ltd.) and mixed for 15 minutes (rotational speed: 5,000 rpm, circulating gas flow temperature: 10° C.). As a result, portions of the respective magnetic particles included in the magnetic powder A were embedded in the surfaces of the toner cores Tc. The thus obtained particles were sifted using a 200-mesh sieve. The particles TcA-6 that passed through the sieve were used to produce the toner T-12.

[Measurement of Shell Layer Thickness Y]

With respect to each of the toners T-1 to T-12 obtained as described above, the shell layer thickness Y of the toner particles included in the toner was measured according to the method described below. Table 1 shows the measurement results.

First, a TEM image of cross-sections of toner particles included in the toner was captured. More specifically, the toner particles were dispersed in a cold-setting epoxy resin and left to stand for 2 days at an ambient temperature of 40° C. to yield a hardened material. The hardened material was dyed using osmium tetroxide. Next, a flake sample (200 nm in thickness) was cut from the dyed hardened material using an ultramicrotome ("EM UC6", product of Leica Microsystems). The resultant flake sample was observed using a transmission electron microscope (TEM) ("JSM-6700F", product of JEOL Ltd.) at magnifications of ×3,000 and ×10,000, and a TEM image of the cross-sections of the toner particles was captured.

The TEM image of the cross-sections of the toner particles was analyzed using image analysis software ("WinROOF", product of Mitani Corporation). More specifically, on the cross-section of one of the toner particles, two straight lines were drawn to intersect at right angles at substantially the center of the cross-section. On the two respective straight lines, lengths (four lengths) that were each from an interface between the toner core and the shell layer (equivalent to the surface of the toner core) to the surface of the shell layer were measured. An arithmetic average value of the thus measured four lengths was taken to be the thickness of the shell layer of the toner particle (measurement target). Such shell layer thickness measurement was performed for 20 toner particles to obtain an average value of shell layer thickness for the 20 toner particles. The thus obtained average value was taken to be the shell layer thickness Y of the toner particles.

In a situation in which a boundary between the toner core and the shell layer was unclear in the TEM image of the cross-section of the toner particle, the TEM image of the cross-section of the toner particle was analyzed using an electron energy loss spectrometer (EELS) ("GIF TRIDIEM (registered Japanese trademark)", product of Gatan, Inc.) and image analysis software ("WinROOF", product of Mitani Corporation).

First, a TEM image of cross-sections of toner particles included in the toner was captured as described above. Next, an image showing the distribution of nitrogen was obtained through analysis of the TEM image using an electron energy loss spectrometer (EELS) ("GIF TRIDIEM", product of Gatan, Inc.) having an energy resolution of 1.0 eV and a beam diameter of 1.0 nm, and image analysis software ("WinROOF", product of Mitani Corporation). Nitrogen is an element that is characteristic of the shell layer material. The image showing the distribution of nitrogen therefore clarified the boundary between the toner core and the shell layer.

[Measurement of Average Value Z of Magnetic Particle Protrusion Heights]

With respect to each of the toners T-1 to T-12 obtained as described above, the average value Z of magnetic particle protrusion heights of the toner particles included in the toner was determined according to the method described below. Table 1 shows the measurement results.

A TEM image of cross-sections of toner particles included in the toner was captured according to the method described in the section of [Measurement of Shell Layer Thickness Y]. The captured TEM image of the cross-sections of the toner particles was analyzed using image analysis software ("WinROOF", product of Mitani Corporation). More specifically, a line length measurement function as a manual measurement function of a measurement tool was selected in the image analysis software. With the line length measurement function as the manual measurement function selected, five magnetic particles that were each partially embedded in the surface of a toner core in the TEM image of the cross-sections of the toner particles were randomly selected. The protrusion heights of the respective five magnetic particles selected were measured, and a number average value thereof was calculated. The number average value of the protrusion heights of the magnetic particles obtained as described above was taken to be the "average value Z of magnetic particle protrusion heights".

[Evaluation of Toner High-Temperature Preservability]

With respect to each of the toners T-1 to T-12 obtained as described above, high-temperature preservability of the toner was evaluated according to the method described below.

First, 3 g of a sample (toner) was placed in a polyethylene container (capacity: 20 mL) and the container was left to stand without a lid for 12 hours under environmental conditions of 23° C. and 50% RH. Next, the container was hermetically sealed with a lid and left to stand in an oven at 60° C. for 3 hours. Next, the container was taken out of the oven and cooled to room temperature (approximately 25° C.), and subsequently the toner was taken out of the container. Thus, an evaluation toner (heated toner) was obtained.

Subsequently, the evaluation toner was placed on a 200-mesh sieve of known mass. The mass of the toner on the sieve (mass of toner before sifting) was calculated by measuring the total mass of the sieve and the toner thereon. Next, the sieve was placed in a powder tester (product of Hosokawa Micron Corporation) and the evaluation toner was sifted in accordance with a manual of the powder tester by shaking the sieve for 30 seconds at a rheostat level of 5. After the sifting, the mass of toner remaining on the sieve (mass of toner after sifting) was calculated by measuring the total mass of the sieve and the toner thereon. Based on the mass of the toner before sifting and the mass of the toner after shifting, a toner particle passage rate (unit: % by mass) was determined in accordance with the following equation.

$$\text{Tone particle passage rate} = 100 - (100 \times \text{Mass of toner after shifting}/\text{Mass of toner before shifting})$$

A toner particle passage rate of 90% or greater was evaluated as excellent. A toner particle passage rate of 80% or greater and less than 90% was evaluated as good. Table 2 shows the evaluation results.

[Preparation of Two-Component Developer]

(Preparation of Developer D-1)

The toner T-1 and a Cu—Zn ferrite carrier (product of Powdertech Co., Ltd., volume resistivity: 107 Ωcm, saturation magnetization: 70 emu/g, average particle diameter: 35 m) were added into a ball mill so as to give a toner particle content of 10% by mass, and then mixed for 30 minutes. Through the above, the two-component developer D-1 was obtained. The Cu—Zn ferrite carrier included ferrite particles (carrier cores) and coat layers of a fluororesin formed on surfaces of the ferrite particles. The amount of the coat layers was 20 parts by mass relative to 100 parts by mass of the ferrite particles.

(Preparation of Two-component Developers D-2 to D-12)

The two-component developers D-2 to D-12 were respectively prepared according to the same method as the preparation of the two-component developer D-1 in all aspects other than that the toners T-2 to T-12 were used instead of the toner T-1.

[Evaluation of Two-Component Developer]

(Evaluation of Low-temperature Fixability)

With respect to each of the two-component developers D-1 to D-12 obtained as described above, an image was formed using the two-component developer to evaluate low-temperature fixability of the toner in the developer.

A printer ("FSC-5250DN", product of KYOCERA Document Solutions Inc.) modified in order to enable adjustment of fixing temperature was used as an evaluation apparatus to evaluate the low-temperature fixability. More specifically, the two-component developer (unused) was loaded into a developing device of the evaluation apparatus, and toner for replenishment use (unused) was loaded into a toner container of the evaluation apparatus. In each Example, the same toner as the toner included in the two-component developer being evaluated (two-component developer loaded into the developing device of the evaluation apparatus) was used as the toner for replenishment use.

Next, a sample image (unfixed image) was formed on printing paper using the evaluation apparatus under conditions of a linear velocity of 200 mm/second and a toner load of 1.0 mg/cm$^2$. The sample image that was formed was fixed to the printing paper. Fixing was performed in a temperature range of from 100° C. to 200° C. by increasing the fixing temperature in increments of 5° C. Accordingly, 21 sheets of printing paper each having the sample image fixed thereto were obtained.

Next, a fold-rubbing test was performed. More specifically, with respect to each of the sheets of printing paper having the sample image fixed thereto, the sheet of printing paper was folded in half such that a surface on which the sample image was formed was folded inwards. A 1 kg weight covered with cloth was rubbed back and forth on the fold of the sheet of printing paper five times. Next, the sheet of printing paper was opened up, and a fold portion, in particular, a portion at which the sample image was formed was observed to measure a length of toner peeling (referred to below as peeling length) of the portion. An evaluation of "Pass" was given when the peeling length was no greater than 1 mm. The minimum fixable temperature was determined to be the lowest temperature among the fixing temperatures for formation of the sample images that were evaluated as "Pass". A minimum fixable temperature of no greater than 140° C. was evaluated as excellent. A minimum fixable temperature of greater than 140° C. and no greater than 150° C. was evaluated as good. A minimum fixable temperature of greater than 150° C. was evaluated as poor. Table 2 shows the evaluation results.

(Evaluation of Image Density)

With respect to each of the two-component developers D-1 to D-12 obtained as described above, an image was formed using the two-component developer to evaluate image density.

A color printer ("TASKalfa 500ci", product of KYOCERA Document Solutions Inc.) was used to evaluate image density. More specifically, the two-component developer (unused) was loaded into a developing device of the color printer, and toner for replenishment use (unused) was loaded into a toner container of the color printer. In the color printer, a voltage difference (ΔV) between a development sleeve and a magnet roll was set to 250 V, and an alternating current voltage (Vpp) applied to the magnet roll was set to 2.0 kV. Under environmental conditions of 10° C. and 10% RH, a sample image having a coverage of 4% was printed on 1,000 successive sheets, and subsequently a sample image (sample image for image density evaluation) having a coverage of 100% was formed on a sheet of printing paper. Thereafter, image density (ID) was measured. The above-described printing and image formation were repeated until the number of printed sheets on which the sample image having a coverage of 4% was formed reached 5,000. That is, image density (ID) was measured every time the sample image having a coverage of 4% was printed on 1,000 successive sheets of printing paper.

In the image density (ID) measurement, a reflection density (ID: image density) of a solid section (solid section of the formed sample image) on the printed sheet of printing paper was measured using a Macbeth reflection densitometer ("RD914", product of X-Rite Inc.). An image density (ID) of 1.20 or greater as measured when the number of sheets on which the sample image having a coverage of 4% was printed reached 5,000 was evaluated as excellent. An image density (ID) of less than 1.20 as measured when the number of sheets on which the sample image having a coverage of 4% was printed reached 5,000 was evaluated as good. An image density (ID) of less than 1.20 as measured when the number of sheets on which the sample image having a coverage of 4% was printed reached 4,000 was evaluated as poor. Table 2 shows the evaluation results.

(Evaluation of Fogging Density)

With respect to each of the two-component developers D-1 to D-12 obtained as described above, an image was formed using the two-component developer to evaluate fogging density.

A color printer ("TASKalfa 500ci", product of KYOCERA Document Solutions Inc.) was used to evaluate fogging density. More specifically, the two-component developer (unused) was loaded into a developing device of the color printer, and toner for replenishment use (unused) was loaded into a toner container of the color printer. In the color printer, a voltage difference (ΔV) between a development sleeve and a magnet roll was set to 250 V, and an alternating current voltage (Vpp) applied to the magnet roll was set to 2.0 kV. Under environmental conditions of 10° C. and 10% RH, a sample image having a coverage of 4% was printed on 1,000 successive sheets, and subsequently a blank sheet of printing paper was output from the color printer without printing of the sample image. Thereafter, fogging density (FD) was measured. The above-described printing and blank sheet output were repeated until the number of printed sheets on which the sample image having a coverage of 4% was formed reached 5,000. That is, fogging density (FD) was measured every time the sample image having a coverage of 4% was printed on 1,000 successive sheets of printing paper.

In the fogging density (FD) measurement, a reflection density of the output blank sheet of printing paper was measured using a color reflection densitometer ("R710", product of Ihara Electronic Industries Co., Ltd.). The fogging density (FD) was calculated in accordance with an equation shown below.

FD=(reflection density of output blank sheet of printing paper)−(reflection density of unprinted sheet of printing paper)

A fogging density (FD) of less than 0.010 as measured when the number of sheets on which the sample image having a coverage of 4% was printed reached 5,000 was evaluated as excellent. A fogging density (FD) of 0.010 or greater as measured when the number of sheets on which the sample image having a coverage of 4% was printed reached 5,000 was evaluated as good. A fogging density (FD) of 0.010 or greater as measured when the number of sheets on which the sample image having a coverage of 4% was printed reached 4,000 was evaluated as poor. Table 2 shows the evaluation results.

(Evaluation of Toner Non-Filming Properties on Surface of Photosensitive Member)

With respect to each of the two-component developers D-1 to D-12 obtained as described above, an image was formed using the two-component developer to evaluate toner non-filming properties on a surface of a photosensitive member.

A color printer ("TASKalfa500ci", product of KYOCERA Document Solutions Inc.) was used to evaluate toner non-filming properties on the surface of the photosensitive member. More specifically, the two-component developer (unused) was loaded into a developing device of the color printer, and toner for replenishment use (unused) was loaded into a toner container of the color printer. In the color printer, a voltage difference (ΔV) between a development sleeve and a magnet roll was set to 250 V, and an alternating current voltage (Vpp) applied to the magnet roll was set to 2.0 kV. Under environmental conditions of 32.5° C. and 80% RH, a sample image having a coverage of 4% was printed on 5,000 successive sheets. Thereafter, a solid image having a coverage of 100% was printed on an entire surface of A4 size printing paper, and a halftone image having a coverage of 50% was printed on an entire surface of A4 size printing paper. Presence or absence of spots and image void in the solid image and the halftone image obtained as described above was confirmed through visual inspection. Furthermore, presence or absence of the toner component adhering to the surface of the photosensitive member was confirmed after formation of the solid image and the halftone image. Table 2 shows the evaluation results.

Excellent: No spots or image void was observed in the solid image and the halftone image, and no toner component adhering to the surface of the photosensitive member was observed.

Good: No spots or image void was observed in the solid image and the halftone image, but the toner component adhering to the surface of the photosensitive member was observed.

Poor: Some spots and image void were observed in the solid image and the halftone image, and the toner component adhering to the surface of the photosensitive member was observed.

In table 2, "Developer" indicates two-component developer. In a top line in each cell under the heading "0<Z≤(X/2)", whether or not the relation 0<Z≤(X/2) is satisfied is shown. In a middle line in each cell under the heading "0<Z≤(X/2)", the average value Z of the magnetic particle protrusion heights is shown. In a bottom line in each cell under the heading "0<Z≤(X/2)", the average Heywood diameter X of the magnetic particles is shown.

In each cell under the heading "Y", the shell layer thickness Y is shown.

In a lower line in each cell under the heading "low-temperature fixability", the minimum fixable temperature is shown.

In a top line in each cell under the heading "ID", the result of the image density evaluation is shown. In a middle line in each cell under the heading "ID", the image density (ID) measured when the number of sheets on which the sample image having a coverage of 4% was printed reached 4,000 is shown. In a bottom line in each cell under the heading "ID", the image density (ID) measured when the number of sheets on which the sample image having a coverage of 4% was printed reached 5,000 is shown.

In a top line in each cell under the heading "FD", the result of the fogging density evaluation is shown. In a middle line in each cell under the heading "FD", the fogging density (FD) measured when the number of sheets on which the sample image having a coverage of 4% was printed reached 4,000 is shown. In a bottom line in each cell under the heading "FD", the fogging density (FD) measured when the number of sheets on which the sample image having a coverage of 4% was printed reached 5,000 is shown.

TABLE 2

| | Developer | 0 < Z ≤ (X/2) | Y (nm) | Low-temperature fixability | ID | FD | Non-filming properties | High-temperature Preservability |
|---|---|---|---|---|---|---|---|---|
| Example 1 | D-1 | Satisfied<br>Z = 20 nm<br>X = 190 nm | 10 | Excellent<br>140° C. | Excellent<br>1.3<br>1.25 | Excellent<br>0.004<br>0.005 | Excellent | Excellent<br>90% |
| Example 2 | D-2 | Satisfied<br>Z = 80 nm<br>X = 190 nm | 50 | Excellent<br>140° C. | Excellent<br>1.28<br>1.28 | Excellent<br>0.005<br>0.005 | Excellent | Excellent<br>92% |
| Example 3 | D-3 | Satisfied<br>Z = 20 nm<br>X = 190 nm | 5 | Excellent<br>135° C. | Good<br>1.22<br>1.18 | Excellent<br>0.005<br>0.004 | Excellent | Good<br>80% |
| Example 4 | D-4 | Satisfied<br>Z = 20 nm<br>X = 200 nm | 10 | Excellent<br>140° C. | Excellent<br>1.24<br>1.22 | Excellent<br>0.005<br>0.005 | Excellent | Excellent<br>90% |
| Example 5 | D-5 | Satisfied<br>Z = 20 nm<br>X = 220 nm | 10 | Excellent<br>140° C. | Excellent<br>1.28<br>1.29 | Excellent<br>0.004<br>0.004 | Good | Excellent<br>90% |
| Example 6 | D-6 | Satisfied<br>Z = 10 nm<br>X = 100 nm | 10 | Excellent<br>140° C. | Excellent<br>1.25<br>1.22 | Excellent<br>0.005<br>0.005 | Good | Excellent<br>90% |
| Example 7 | D-7 | Satisfied<br>Z = 80 nm<br>X = 300 nm | 10 | Good<br>145° C. | Good<br>1.22<br>1.19 | Excellent<br>0.005<br>0.005 | Good | Excellent<br>90% |
| Example 8 | D-8 | Satisfied<br>Z = 20 nm<br>X = 190 nm | 10 | Excellent<br>140° C. | Excellent<br>1.31<br>1.29 | Good<br>0.008<br>0.011 | Good | Excellent<br>90% |
| Example 9 | D-9 | Satisfied<br>Z = 20 nm<br>X = 190 nm | 10 | Good<br>150° C. | Good<br>1.2<br>1.17 | Excellent<br>0.002<br>0.001 | Excellent | Excellent<br>95% |
| Comparative Example 1 | D-10 | Satisfied<br>Z = 20 nm<br>X = 190 nm | 90 | Poor<br>155° C. | Excellent<br>1.26<br>1.26 | Excellent<br>0.004<br>0.005 | Excellent | Excellent<br>98% |
| Comparative Example 2 | D-11 | Not satisfied<br>Z = 100 nm<br>X = 190 nm | 10 | Excellent<br>140° C. | Poor<br>1.11<br>1.08 | Poor<br>0.023<br>0.021 | Poor | Excellent<br>90% |
| Comparative Example 3 | D-12 | Not satisfied<br>Z = 0 nm<br>X = 190 nm | 10 | Good<br>145° C. | Excellent<br>1.21<br>1.22 | Excellent<br>0.005<br>0.005 | Poor | Excellent<br>90% |

In each cell under the heading "Non-filming properties", the result of evaluation of the toner non-filming properties on the surface of the photosensitive member is shown.

In a lower line in each cell under the heading "high-temperature preservability", the toner particle passage rate is shown.

Each of the two-component developers D-1 to D-9 (the two-component developers according to Examples 1 to 9) included toner particles having the above-described basic structure. More specifically, each of the toner particles had a toner core, a shell layer covering the surface of the toner core, and a plurality of magnetic particles penetrating the shell layer. Each of the magnetic particles had an embedded portion and a protrusion portion. The embedded portions were embedded in the surface of the toner core. The protrusion portions were located further outward than the embedded portions in the radial direction of the toner particle and protruded outward from the surface of the shell layer in the radial direction of the toner particle. The average Heywood diameter X of the magnetic particles, the shell layer thickness Y, and the average value Z of the magnetic particle protrusion heights of the toner particle satisfied relation (1) and relation (2) shown below.

$$0<Z\leq(X/2) \quad (1)$$

$$10\ \text{nm}\leq Y\leq 50\ \text{nm} \quad (2)$$

As shown in Table 2, the two-component developers D-1 to D-9 each showed the effects of improving toner low-temperature fixability, preventing occurrence of fogging, and improving developing properties in the case of image formation in a low-humidity environment.

The two-component developer D-10 (the two-component developer according to Comparative Example 1) was inferior to the two-component developers D-1 to D-9 in the low-temperature fixability evaluation. More specifically, the minimum fixable temperature of the two-component developer D-10 was higher. It is thought that such a result was obtained because the two-component developer D-10 had a shell layer thickness Y of greater than 50 nm.

The two-component developer D-11 (the two-component developer according to Comparative Example 2) was inferior to the two-component developers D-1 to D-9 in the image density (ID) evaluation, the fogging density (FD) evaluation, and the non-filming property evaluation. More specifically, the two-component developer D-11 resulted in a decreased image density (ID) as measured when the number of sheets on which the sample image having a coverage of 4% was printed reached 4,000 in the image density evaluation. The two-component developer D-11 resulted in a higher fogging density (FD) as measured when the number of sheets on which the sample image having a coverage of 4% was printed reached 4,000 in the fogging density evaluation. In the non-filming property evaluation of the two-component developer D-11, some spots and image void were observed in the solid image and the halftone image, and the toner component adhering to the surface of the photosensitive member was observed. It is thought that such a result was obtained because $Z\leq(X/2)$ was not satisfied in the two-component developer D-11.

The two-component developer D-12 (the two-component developer according to Comparative Example 3) was inferior to the two-component developers D-1 to D-9 in the non-filming property evaluation. More specifically, in the non-filming property evaluation of the two-component developer D-12, some spots and image void were observed in the solid image and the halftone image, and the toner component adhering to the surface of the photosensitive member was observed. It is thought that such a result was obtained because $0<Z$ was not satisfied in the two-component developer D-12.

What is claimed is:

1. A toner comprising a plurality of toner particles, wherein each of the toner particles includes a toner core, a shell layer covering a surface of the toner core, and a plurality of magnetic particles penetrating the shell layer, each of the magnetic particles has an embedded portion and a protrusion portion, the embedded portions are embedded in the surface of the toner core, the protrusion portions are located further outward than the embedded portions in a radial direction of the toner particle and protrude outward from a surface of the shell layer in the radial direction of the toner particle, an average Heywood diameter X of the magnetic particles, a thickness Y of the shell layer, and an average value Z satisfy relation (1) and relation (2) shown below, and $$0<Z\leq(X/2) \quad (1)$$

$$10\ \text{nm}\leq Y\leq 50\ \text{nm} \quad (2)$$

the average value Z in relation (1) is an average value of lengths of the protrusion portions in the radial direction of the toner particle.

2. The toner according to claim 1, wherein the average Heywood diameter X of the magnetic particles is at least 100 nm and no greater than 300 nm.

3. The toner according to claim 1, wherein the magnetic particles each have a polyhedral shape, and the magnetic particles are contained in an amount of at least 0.5 parts by mass and no greater than 3.0 parts by mass relative to 100.0 parts by mass of the toner cores.

4. The toner according to claim 1, wherein the toner core does not contain magnetic particles as an internal additive.

5. The toner according to claim 1, wherein each of the magnetic particles has a magnetic core, the magnetic core is formed from magnetite, and the shell layer includes a melamine resin.

6. A one-component developer comprising the toner according to claim 1.

7. A two-component developer comprising:

the toner according to claim 1; and a carrier that positively charges the toner through friction.

* * * * *